US010400595B2

(12) United States Patent
Chok et al.

(10) Patent No.: US 10,400,595 B2
(45) Date of Patent: Sep. 3, 2019

(54) REAL-TIME DETERMINATION OF FORMATION FLUID PROPERTIES USING DENSITY ANALYSIS

(71) Applicants: Hamed Chok, Houston, TX (US); Jeffery J. Hemsing, Humble, TX (US); Jess V. Ford, Weatherford, TX (US)

(72) Inventors: Hamed Chok, Houston, TX (US); Jeffery J. Hemsing, Humble, TX (US); Jess V. Ford, Weatherford, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 783 days.

(21) Appl. No.: 13/827,931

(22) Filed: Mar. 14, 2013

(65) Prior Publication Data

US 2014/0278113 A1 Sep. 18, 2014

(51) Int. Cl.
*E21B 49/08* (2006.01)

(52) U.S. Cl.
CPC ..... *E21B 49/088* (2013.01)

(58) Field of Classification Search
CPC ..... E21B 43/14; E21B 49/088; E21B 49/10
USPC ..... 702/8, 11, 12, 13, 179, 183; 73/152.55; 166/279; 703/10
See application file for complete search history.

(56) References Cited

U.S. PATENT DOCUMENTS 6,295,504 B1 9/2001 Ye
6,748,328 B2 6/2004 Storm, Jr. et al.
7,792,770 B1 9/2010 Phoha
9,390,112 B1 7/2016 Daly
2005/0133261 A1 6/2005 Ramakrishnan
2006/0092766 A1 5/2006 Shelley et al.
(Continued)

FOREIGN PATENT DOCUMENTS

WO 2010/083166 A2 7/2010
WO 2013/023299 A1 2/2013

OTHER PUBLICATIONS

Proett, Mark, et al., "Formation Testing Goes Back to the Future," SPWLA 51st Annual Logging Symposium, Jun. 19-23, 2010, copyright 2010.

(Continued)

*Primary Examiner* — Eman A Alkafawi
(74) *Attorney, Agent, or Firm* — Blank Rome LLP

(57) ABSTRACT

Analysis evaluates formation fluid with a downhole tool disposed in a borehole. A plurality of possible constituents is defined for the formation fluid, and constraints are defined for the possible constituents. The constraints can include boundary constraints and constraints on the system's dynamics. The formation fluid is obtained from the borehole with the downhole tool over a plurality of time intervals, and density of the obtained formation fluid is obtained at the time intervals. To evaluate the fluid composition, a state probability distribution of the possible constituents of the obtained formation fluid at the current time interval is computed recursively from that at the previous time interval and by assimilating the current measured density of the obtained formation fluid in addition to the defined boundary/dynamic constraints. The probabilistic characterization of the state of the possible constituents allows, in turn, the probabilistic inference of formation properties such as contamination level and GOR.

22 Claims, 4 Drawing Sheets

(56) References Cited

U.S. PATENT DOCUMENTS

| | | | | |
|---|---|---|---|---|
| 2006/0155472 | A1* | 7/2006 | Venkataramanan | E21B 49/00 702/10 |
| 2006/0158184 | A1* | 7/2006 | Edwards | G01N 24/081 324/303 |
| 2007/0119244 | A1* | 5/2007 | Goodwin | E21B 47/10 73/152.28 |
| 2008/0133194 | A1* | 6/2008 | Klumpen | E21B 49/00 703/10 |
| 2008/0162098 | A1 | 7/2008 | Suarez-Rivera | |
| 2010/0198638 | A1 | 8/2010 | Deffenbaugh et al. | |
| 2011/0088949 | A1 | 4/2011 | Zuo et al. | |
| 2012/0065888 | A1 | 3/2012 | Wu | |
| 2013/0096835 | A1 | 4/2013 | Chok et al. | |
| 2013/0233542 | A1* | 9/2013 | Shampine | E21B 43/26 166/279 |
| 2013/0262069 | A1* | 10/2013 | Leonard | E21B 43/00 703/10 |
| 2013/0319989 | A1 | 11/2013 | Cheng et al. | |
| 2013/0340518 | A1* | 12/2013 | Jones | E21B 49/005 73/152.55 |
| 2014/0236486 | A1 | 8/2014 | Leseur | |
| 2015/0153476 | A1 | 6/2015 | Prange | |

OTHER PUBLICATIONS

Avis, D. et al., "A Pivoting Algorithm for Convex Hulls and Vertex Enumeration of Arrangements and Polyhedra", Discrete Computational Geometry, vol. 8 (1992), 295-313.

Avis, D, "Irs: A Revised Implementation of the Reverse Search Vertex Enumeration Algorithm". In G. Kalai and G.M. Ziegler, editors, Polytopes—Combinatorics and Computation, vol. 29 (2000) if Oberwolfach Seminars, Birkhäuser—Verlag, 177-198.

Bremner, D. et al., "Primal-Dual Methods of Vertex and Facet Enumeration", Discrete Computational Geometry, vol. 20 (1997), 333-358.

Cignoni, P. et al., "DeWall: A Fast Divide and Conquer Delaunay Triangulation Algorithm in Ed." Computer-Aided Design, vol. 30 (1998), 333-341.

Fukuda, K. et al., "Analysis of Backtrack Algorithms for Listing All Vertices and All Faces of a Convex Polyhedron", Computational Geometry: Theory and Applications, vol. 8 (1997), 1-12.

Bottomley, H. "Partition Calculators Using Java Applets—Henry Bottomley 2002," dated 2002, obtained from www.se16.info/js/partitions.htm on Apr. 22, 2016.

Khachiyan, L. et al., "Generating All Vertices of a Polyhedron is Hard," Discrete Comput Geom (2008) 39: 174-190, received Jul. 21, 2005.

Matheiss, T.H., et al., "A Survey and Comparison of Methods for Finding all Vertices of Convex Polyhedral Sets." Math. Operations Research., vol. 5 (1980), 167-185.

Int'l Search Report and Written Opinion in counterpart PCT Appl. PCT/US2014/023139, dated Jun. 29, 2015.

Examination Report No. 1 in counterpart Australian Appl. 2014240993, dated Feb. 9, 2016.

Bernardini, F., "Integration of Polynomials over n-Dimensional Polyhedral," Computer-Aided Design, vol. 23 (1991), pp. 51-58.

Crosier, R. B., "The Geometry of Constrained Mixture Experiments," Technometrics, vol. 28 (1986), pp. 95-102.

Dyer, M. E., "The Complexity of Vertex Enumeration Methods," Mathematics of Operations Research, vol. 8 (1983), pp. 381-402.

McLean et al., "Extreme vertices design of mixture experiments," Technometrics, vol. 8 (1966), pp. 447-454.

Snee et al., "Extreme vertices designs for linear mixture models," Technometrics, vol. 16 (1974), pp. 399-408.

First Office Action in counterpart Canadian Appl. 2906360, dated Oct. 27, 2016, 3-pgs.

Second Office Action in counterpart Canadian Appl. 2906360, dated Jun. 7, 2017, 3-pgs.

Third Office Action in counterpart Canadian Appl. 2906360, dated May 23, 2018, 3-pgs.

First Examination Report in counterpart EP Appl. 147252563, dated Apr. 24, 2018, 4-pgs.

* cited by examiner

REAL-TIME DETERMINATION OF FORMATION FLUID PROPERTIES USING DENSITY ANALYSIS

BACKGROUND OF THE DISCLOSURE

Fluid sampling is one useful step used for characterizing a reservoir. In-situ fluid composition analysis can be performed during the fluid sampling, and many properties of interest (e.g., GOR) can be inferred about the formation fluid. Knowledge of these properties is useful in characterizing the reservoir and in making of any engineering and business decisions.

The formation fluid obtained during the fluid sampling has a number of unknown natural constituents, such as water, super critical gas, and liquid hydrocarbons. In addition to these unknown natural constituents, the composition of the formation fluid sample may also include an artificial contaminant (i.e., filtrate including water-based mud or oil-based mud), which has been used during drilling operations. Therefore, during fluid sampling downhole, the fluid initially monitored with a fluid sampling device or other instrument is first assumed to be fully contaminated. Then, the monitored fluid is assumed to go through a continuous cleanup process as more formation fluid is obtained from the area of interest.

During cleanup, repeated density measurements are taken at fixed time intervals, and the density measurements are analyzed to estimate the sample's quality. For example, the repeated density measurements can be used to plot the change in density over time. Characteristics of this density-time plot are then used to assess the contamination level of the fluid being sampled. Once a minimum threshold contamination level is believed to be reached, the sample is then captured and stored in the tool so the sample can be returned to the surface and can undergo additional analysis.

For example, FluidXpert® is software that can analyze density sensor data and can estimate the current level of contamination and the amount of time required to reach a desired level of contamination. Since the filtrate density and the uncontaminated formation fluid density are not known and can only be estimated based on the filtrate properties and the pressure gradient, too much uncertainty is present to make a definitive determination that the desired level of contamination has actually been reached. All the same, even with such uncertainty, the information obtained is considered acceptable for regression trend analysis to estimate contamination.

An example of such an approach is disclosed in U.S. Pat. No. 6,748,328 to Storm, Jr. et al., which discloses a method for determining the composition of a fluid by using measured properties (e.g., density) of the fluid. The quality of a fluid sample obtained downhole is evaluated by monitoring the density of the fluid sample over time. During the sampling process, the density of the sample volume changes until it levels out to what is expected to be the density of the formation fluid. Unfortunately, a point of equilibrium may simply be reached between the amounts of formation fluid and filtrate contamination in the sample volume so that the level of contamination is not really known.

To solve this, Storm, Jr. et al. assumes a mixture for the sampled fluid that has only two components, namely filtrate and formation fluid. In this way, the incremental change in the fluid mixture's density corresponds to an incremental change in the volume fraction of the two fluid components by the difference between the two fluid components' densities. The endpoint values for the mixture's change in density include (1) the density of the filtrate (which can be determined based on surface measurements of the mud system) and (2) the density of the formation fluid (which can be determined from pressure gradient data). In the end, Storm, Jr. et al. can indicate the composition of the mixture (i.e., the relative fraction of filtration in the mixture compared to formation fluid) based on the change in the mixture's density over time.

In addition to monitoring density, pressure, temperature, and the like, various other modules can perform analysis downhole. For example, spectrophotometers, spectrometers, spectrofluorometers, refractive index analyzers, and similar devices have been used to analyze downhole fluids by measuring the fluid's spectral response with appropriate sensors. Although useful and effective, these analysis modules can be very complex and hard to operate in the downhole environment. Additionally, these various analysis modules may not be appropriate for use under all sampling conditions or with certain types of downhole tools used in a borehole to determine characteristics of formation fluid.

The subject matter of the present disclosure is directed to overcoming, or at least reducing the effects of, one or more of the problems set forth above.

DETAILED DESCRIPTION OF THE DISCLOSURE

In this disclosure, a dynamic (i.e., real-time) fluid composition analysis is devised as a full-scale estimator of the composition of a fluid sample from a formation based on density measurements made at discrete points-in-time downhole as the sampled fluid is cleaned-up. In other words, the disclosed dynamic fluid composition analysis can estimate the fraction of each and every constituent presumably present in the formation fluid. The presumed constituents can include one or more of water, a gas, a vapor phase gas, a supercritical gas, a natural gas, carbon dioxide, hydrogen sulfide, nitrogen, a hydrocarbon, a liquid hydrocarbon, a filtrate contaminant, a solid, and the like.

The presumption of the existence of any particular constituent is not limited in any way. In fact, the disclosed analysis enumerates a plurality (if not all) possible constituents that may exist in the formation fluid, predefines linear constraints on the fraction range of each constituent as well as constraints on the fraction dynamics in discrete points-in-time (i.e., at fixed time intervals, time steps, or time ticks), and computes estimates of the constituents' fractions and their confidence levels after dynamically assimilating the boundary constraints and the constraints on the system dynamics in real-time with the observed density for each new time interval. By implication, the disclosed analysis can infer reservoir properties that may relate two or more constituents, such as the gas-to-oil ratio (GOR), which is defined as the volumetric ratio of the super critical gas and liquid hydrocarbon components.

A. Downhole Implementation

Figure 1:
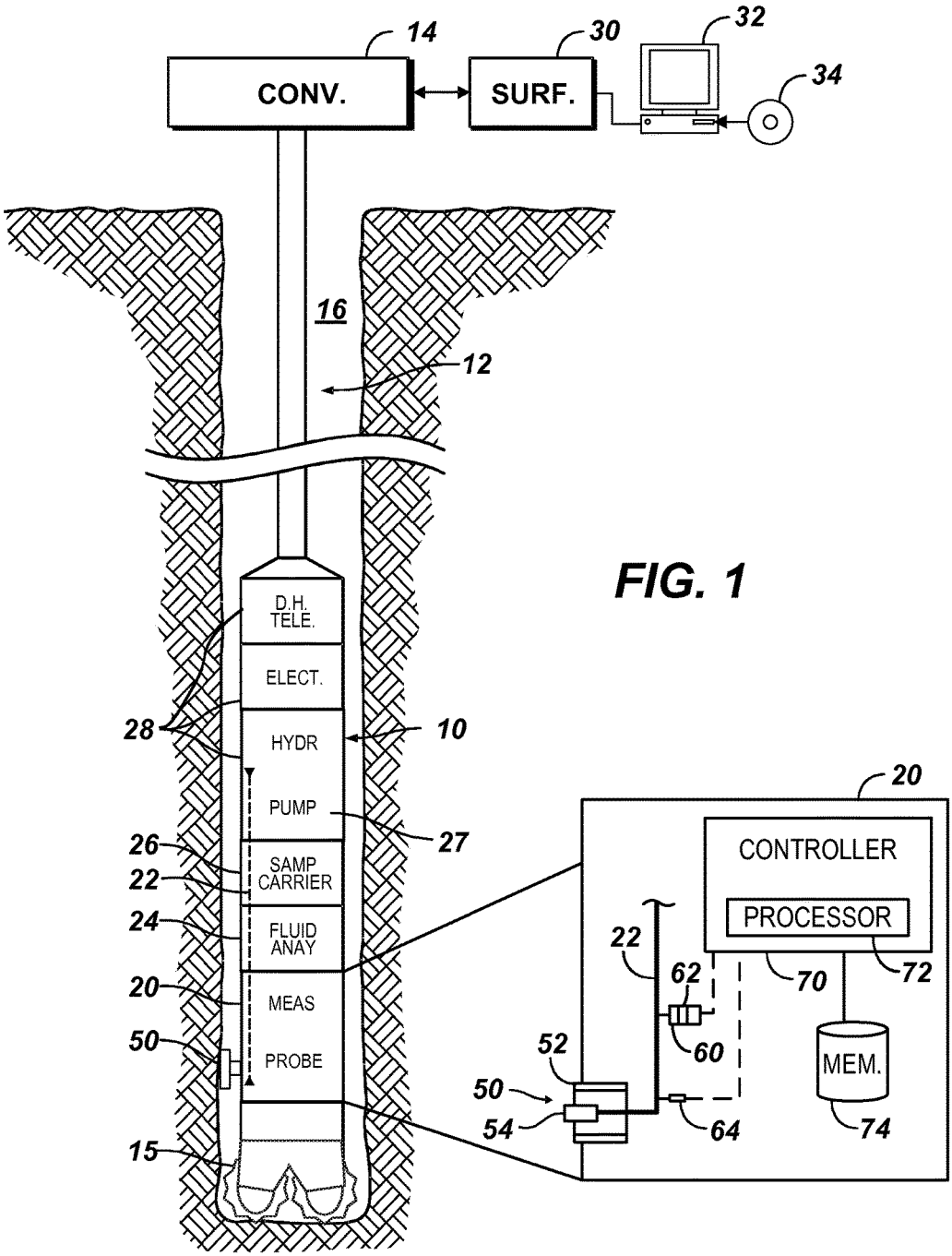
FIG. 1 illustrates one application for performing dynamic (i.e., real-time) fluid composition analysis on formation fluid obtained with a formation-testing tool in a borehole.

FIG. 1 shows one application for employing real-time fluid composition analysis according to the present disclosure to analyze the composition of formation fluid in a borehole. In this application of FIG. 1, a downhole tool 10 analyzes fluid measurements from a formation. A conveyance apparatus 14 at the surface deploys the downhole tool 10 in a borehole 16 using a drill string, a tubular, a cable, a wireline, or other component 12.

The tool 10 can be any tool used for wireline formation testing, production logging, Logging While Drilling/Measurement While Drilling (LWD/MWD), or other operations. For example, the tool 10 as shown in FIG. 1 can be part of an early evaluation system disposed on a drill collar of a bottomhole assembly having a drill bit 15 and other necessary components. In this way, the tool 10 can analyze the formation fluids shortly after the borehole 16 has been drilled. As such, the tool 10 can be a Fluid-Sampling-While-Drilling (FSWD) tool. Alternatively, the tool 10 can be a wireline pump-out formation testing (WPFT) tool or any other type of testing tool.

In use, the tool 10 obtains formation fluids and measurements at various depths in the borehole 16 to determine properties of the formation fluids in various zones. To do this, the tool 10 can have a probe 50, a measurement device 20, and other components for in-situ sampling and analysis of formation fluids in the borehole 16. Rather than a probe 50, the tool 10 can have an inlet with straddle packers or some other known sampling component. As fluid is obtained at a given depth, its composition evolves over time during the pump-out process as the fluid is being cleaned up. Cleanup is the process whereby filtrate fluid is removed from the pump-out region, which allows for direct sampling of formation fluids. However, mud filtrate along the borehole wall dynamically invades the formation during this process so that an equilibrium is established, which essentially limits any final cleanup or contamination level that can be attained.

The cleanout process can take as little as 10 min. to many hours irrespective of the type of tool being used. The time required also depends on the type of probe 50 or other sample inlet employed (typically packers) and the type of drilling mud used. In general, any suitable type of formation testing inlet known in the art can be used, with some being more beneficial than others. Also, the disclosed analysis can be used with any type of drilling mud, such as oil-based or water-based muds.

During this pump-out process, measurements are recorded in a memory unit 74, communicated or telemetered uphole for processing by surface equipment 30, or processed locally by a downhole controller 70. Each of these scenarios is applicable to the disclosed fluid composition analysis.

Although only schematically represented, it will be appreciated that the controller 70 can employ any suitable processor 72, program instructions, memory 74, and the like for achieving the purposes disclosed herein. The surface equipment 30 can be similarly configured. As such, the surface equipment 30 can include a general-purpose computer 32 and software 34 for achieving the purposes disclosed herein.

The tool 10 has a flow line 22 that extends from the probe 50 (or equivalent inlet) and the measurement section 20 through other sections of the tool 10. The inlet obtains fluid from the formation via the probe 50, isolation packers, or the like. As noted above, any suitable form of probe 50 or isolation mechanism can be used for the tool's inlet. For example, the probe 50 can have an isolation element 52 and a snorkel 54 that extend from the tool 10 and engage the borehole wall. A pump 27 lowers pressure at the snorkel 54 below the pressure of the formation fluids so the formation fluids can be drawn through the probe 50.

In a particular measurement procedure of the probe 50, the tool 10 positions at a desired location in the borehole 16, and an equalization valve (not shown) of the tool 10 opens to equalize pressure in the tool's flow line 22 with the hydrostatic pressure of the fluid in the borehole 16. A pressure sensor 64 measures the hydrostatic pressure of the fluid in the borehole. Commencing test operations, the probe 50 positions against the sidewall of the borehole 16 to establish fluid communication with the formation, and the equalization valve closes to isolate the tool 10 from the borehole fluids. The probe 50 then seals with the formation to establish fluid communication.

At this point, the tool 10 draws formation fluid into the tool 10 by retracting a piston 62 in a pretest chamber 60. This creates a pressure drop in the flow line 22 below the formation pressure. The volume expansion is referred to as "drawdown" and typically has a characteristic relationship to measured pressures.

Eventually, the piston 62 stops retracting, and fluid from the formation continues to enter the probe 50. Given a sufficient amount of time, the pressure builds up in the flow line 22 until the flow line's pressure is the same as the pressure in the formation. The final build-up pressure measured by the pressure sensor 64 is referred to as the "sand face" or "pore" pressure and is assumed to approximate the formation pressure.

During this process, sensors in the tool 10 can measure the density of the drawn fluid and can determine when the drawn fluid is primarily formation fluids. At various points, components such as valves, channels, chambers, and the pump 27 on the tool 10 operate to draw fluid from the formation that can be analyzed in the tool 10 and/or stored in one or more sample chambers 26. For example, the tool 10 may conduct a pre-test drawdown analysis in which a volume of fluid is drawn using a pre-test piston to determine the state (e.g., formation pressure) at time (0). Once the pretest analysis is completed, the downhole fluid pump 27 continuously moves fluid from the inlet or probe 50 and through the sensor sections (20 and 24), allowing for the continuous monitoring of the fluid density and contamination prediction prior to formation sample acquisition in sample chambers 26. Eventually, the probe 50 can be disengaged, and the tool 10 can be positioned at a different depth to repeat the test cycle.

Because the intention is to determine properties of the formation fluid, obtaining uncontaminated sampled fluid with the probe 50 is important. The sampled fluid can be contaminated by drilling mud because the probe 50 has made a poor seal with borehole wall because mud filtrate has invaded the formation, and/or dynamic filtration through the mudcake establishes an equilibrium inflow during pump-out operations. Therefore, the fluid can contain hydrocarbon components (solids, liquids, and/or supercritical gas) as well as drilling mud filtrate (e.g., water-based mud or oil-based mud) or other contaminants. The drawn fluid flows through the tool's flow line 22, and various instruments and sensors (20 and 24) in the tool 10 analyze the fluid.

For example, the probe 50 and measurement section 20 can have sensors that measure various physical parameters (i.e., pressure, flow rate, temperature, density, viscosity, resistivity, capacitance, etc.) of the obtained fluid, and a measurement device, such as a spectrometer or the like, in a fluid analysis section 24 can determine physical and chemical properties of oil, water, and gas constituents of the fluid downhole using optical sensors. Eventually, fluid directed via the flow line 22 can either be purged to the annulus or can be directed to the sample carrier section 26 where the samples can be retained for additional analysis at the surface.

Additional components 28 of the tool 10 can hydraulically operate valves, move formation fluids and other elements within the tool 10, can provide control and power to various electronics, and can communicate data via wireline, fluid telemetry, or other method to the surface. Uphole, surface equipment 30 can have a surface telemetry unit (not shown) to communicate with the downhole tool's telemetry components. The surface equipment 30 can also have a surface processor (not shown) that performs processing of the data measured by the tool 10 in accordance with the present disclosure.

B. Real-Time Fluid Composition Analysis

1. Overview

Briefly, the real-time fluid composition analysis uses a mathematical algorithm to estimate the composition of formation fluid based on fluid density measurements made in discrete time. As discussed above, the composition of the sampled formation fluid evolves over time as it is being cleaned up. Therefore, the analysis casts the evolving composition as an estimate of a discrete-time multivariate dynamic state and constructs a recursive online framework to statistically characterize the dynamic state vector at each new time interval in the analysis. The real-time state characterization, in turn, can be used to infer confidence intervals on crucial fluid properties, which are functions of the composition, such as the fluid contamination fraction and the GOR. Knowing confidence intervals on such properties can help optimize operations and engineering decisions.

In general terms, the fluid composition analysis combines (1) analytical geometry to define the span of the state vector via state boundary conditions and a fundamental density equation, and (2) probability theory to define constraints on the state evolution and to characterize the state probability distribution over the state space. Turning to particular details of the fluid composition analysis of the present disclosure, the following subsections first describe the building blocks needed to formally define the problem at hand.

2. Fundamental Density Equation

The fluid being sampled downhole is a mixture of fluid components. For the fluid component mixture under investigation in the analysis, the fluid mass satisfies an additive property—i.e., the total fluid mass is the sum of the masses of the individual components. This can be expressed as follows:

$$m = \sum_i m_i$$

where m is the total mass, and where $m_i$ is the mass of the $i^{th}$ constituent.

Using the fundamental definition of fluid density relating mass and volume, the above equation is equivalently written as follows:

$$\rho = \sum_i \rho_i \frac{v_i}{v}$$

where, ρ and v are the fluid mixture's density and the fluid mixture's volume, respectively. In the above equation, $\rho_i$ and $v_i$ denote respectively the density and the volume of the individual constituent indexed by i. The ratio can $$\frac{v_i}{v}$$

be relabeled by variable $f_i$ to indicate the volume fraction of the $i^{th}$ constituent. Since volume fractions $f$ are positive and must sum up to one, the last form of the density equation above can be equivalently written in these terms:

$$\begin{cases} 1 = \sum_i f_i \frac{\rho_i}{\rho} \\ 1 = \sum_i f_i \\ f_i \geq 0, \forall i \end{cases}$$

The above linear system of equalities and inequalities in terms of the set $\{f_i\}_i$ defines the complete state space of the vector $\langle f_i \rangle_i$ with i iterating through all constituents. A minimal reflection reveals that the fraction state vector $\langle f_i \rangle_i$ (hereafter denoted as state vector $f$) lies necessarily in the intersection of a hyperplane defined by the density equation and the standard simplex defined by the above-noted set of inequalities and the equation obtained by the rule of fractions. In general, this intersection yields a convex polyhedron P.

Note that for any given time interval in the measurement procedure of the disclosed analysis, the complete state space P for the state vector $f$ is parameterized only via the density ρ. Therefore, given that a new density is observed at every new time interval in the measurement procedure and assuming that every data point in the complete state space P is equally probable, integrating the fraction state vector $f$ over the complete state space P and dividing by the volume of the polyhedron state space P should give the mean state vector. Similarly, higher-order moments may be calculated to characterize the statistical distribution of the fraction state vector $f$ over the complete state space P. This scheme defines a way to statistically characterize the state vector so inferences can be made about any constituent of interest and the properties relating two or more constituents (e.g., GOR).

However, note that this scheme only depends on the density value at the given time interval during the measurement procedure. In particular, characterization of the state vector at any given time interval does not depend on the state vector of any previous time intervals. In other words, this scheme is time-independent or static.

Although the above scheme can sufficiently serve to provide an estimate of the state vector as well as probabilistic guarantees about such an estimate, it is clear that such a scheme can benefit from additional information (other than the density information). Such additional information can be assimilated to refine the distribution of the state vector leading to better quality estimates.

The next two subsections describe additional information that may be used to more accurately characterize the state vector. For instance, Section B.3 delineates the state boundary constraints and how they can be utilized to derive better estimates, and Section B.4 explains how state dynamic constraints may be assimilated to further enhance the estimation and its guarantees.

For simplicity of in the current discussion, the density measurements obtained are assumed to be error free. However, Section F later handles the case of erroneous density measurements and shows how the forthcoming algorithm can seamlessly incorporate errors in density observations without requiring any modifications given a simple assumption on the statistical characterization of the measurement noise. For all other characterizations of the measurement noise, simple additional computation will be performed.

3. State Boundary Constraints

The density equation uses the density coefficients and the observed mixture's density to define the span of the state vector $f$. The complete state space P spanned by the state vector $f$ is rather too large to have an estimate of small enough variance. In reality, the complete state space P is a very loose superset of the true space of the state vector $f$. With the aid of additional information, the span of the state vector $f$ can be narrowed to yield a smaller estimate variance.

In one embodiment, the fluid composition analysis places state boundary constraints on the analysis by imposing linear constraints on the fraction of any constituent presumed in the formation. A particular implementation can use a reduced or specific set of constituents as detailed below. In fact, the boundary constraints and particular constituents can be predefined for a particular implementation, such as a particular reservoir, geographical region, and formation. In this way, the implementation can be tailored to the particular constituents to be expected or analyzed. For the purposes of the current discussion, the set of all constituents assumed present is comprehensive of all elements (e.g., materials or fluids) that may be expected in any formation.

Just a few examples of state boundary constraints imposing linear constraints on the fraction of any constituent presumed in the formation are discussed here. Other state boundary constraints can be determined by one of ordinary skill in the art having the benefit of the present disclosure. As an example, the volumetric fraction of $CH_4$ in any gas mixture should not be less than 70% of the total gas mixture. Similarly, $CO_2$'s fraction should not exceed 5% of the total gas mixture. Pentanes' volume fraction is not expected to exceed 3% of any oil mixture, whereas Nonanes can constitute as high as 15% of any oil composition. In the end, the fraction of every constituent may be constrained with respect to the total fraction of the components of the same phase type—i.e., liquid or gaseous.

As will be appreciated with the benefit of the present disclosure, these and other such constraints may be established from historical data or scientific knowledge. Cross-phase constraints may also be constructed if details (e.g., dry gas, condensate, heavy oil, etc.) on the particular reservoir in question are available. Thus, these and other constraints can be used in the disclosed fluid composition analysis.

To formalize the state boundary constraints, the set of all constituents are first partitioned into sets of gas (G) and oil (O) denoting the supercritical gas and liquid hydrocarbon constituents, respectively. The constraints on a particular gas constituent $c_{gas}$ is represented as follows:

$$\alpha_{c_{gas}} \sum_{g \in G} f_g \leq f_{c_{gas}} \leq \beta_{c_{gas}} \sum_{g \in G} f_g$$

where $\alpha_c$ and $\beta_c$ are the lower and upper fraction bounds, respectively.

Similarly, if $c_{oil}$ is an oil component, the linear constraints on the fraction of $c_{oil}$ is represented as follows:

$$\alpha_{c_{oil}} \sum_{o \in O} f_o \leq f_{c_{oil}} \leq \beta_{c_{oil}} \sum_{o \in O} f_o$$

Then, a collection H of all constraints for all constituent fractions will constitute the state boundary constraints for the state vector $f$. Every inequality in H is either an upper or lower bounding hyperplane for the state vector $f$. Therefore, the reduced state space for the state vector $f$ is the portion of the complete state space P within the bounding hyperplanes defined by the collection H of all constituent fractions, which is itself a polyhedron subset of the complete state space P.

4. State Dynamic Constraints

In the previous Section I.B.3 above, the stretch of the state space for the state vector $f$ was narrowed. By implication, the estimate variance is also narrowed. At every given time interval during the measurement process, the state vector $f$ is contained within a well-defined polyhedron having dimension in the order of the number of constituents. Again, if every data point in the constrained state space is assumed equally likely, integrating the state vector $f$ over the polyhedron space P gives its mean value. In a similar fashion, the covariance matrix and higher order moments of the state vector $f$ may be computed and used statistically to derive confidence intervals on the estimate of the state of the fluid under investigation.

To this end, the fluid composition analysis is static—i.e., time-independent. The state of the sampled formation fluid described herein is, however, inherently dynamic. As noted before, the fluid state or the component fraction vector evolves over time due to the cleanup process during measurement, which alters the overall composition following every new time interval by removing a portion of fluid contaminant. By constraining the state dynamics that govern how the state evolves with respect to time, such information can be used dynamically (i.e., in real-time or continuously) to help better characterize the distribution of the state vector $f$, and hence give better accuracy of the estimate.

In practice, the amount of contaminant removed at each time interval cannot be assessed directly; however, previous information of the cleanup process experienced with the particular testing tool 10 being used can help establish some expectations on the range of the amount of contaminant removed for a given time interval in the measurement process. For example, depending on the tool 10 used and other factors, it may be assumed that following every new time interval of 30 seconds, the fraction of the contaminant may drop by a factor of anywhere between 0 and 10% of its value compared to the previous time interval. (Other assumptions may apply for other implementations.) This assumption will not solely drive the contamination model. Instead, the assumption of cleanup between time intervals serves to constrain the state dynamics by forcing a minimum and maximum threshold on the change encountered for the contamination constituent. As such, the assumption will be used in conjunction with the dynamic density observation.

5. Summary

With the benefit of the above discussion, the measurement process and the fluid composition analysis can be summarized as follows. At an initial time interval t=0, the sampled fluid is known to be near entirely (i.e., ≈100%) composed of contaminant (filtrate). As the fluid is subjected to the cleanup process during measurement, fluid density is measured at time intervals, time steps, or time ticks with discrete time steps. The analysis then models the fluid state as it progresses over time using the (1) state boundary constraints, (2) the state dynamic constraints, and (3) the observed density. All of this information is processed dynamically following every new time interval to yield a multivariate probability distribution of the fluid state. Based upon such a distribution, inferences of interest are made about the fluid composition and related properties (e.g., contamination level, GOR, etc.). In turn, the details of the fluid composition determined by the system 10 and related properties can be used for operation and interpretation services or to guide engineering and business decisions concerning the formation fluid analyzed.

C. Embodiment of Real-Time Fluid Composition Analysis

1. Overview

Figure 2A:
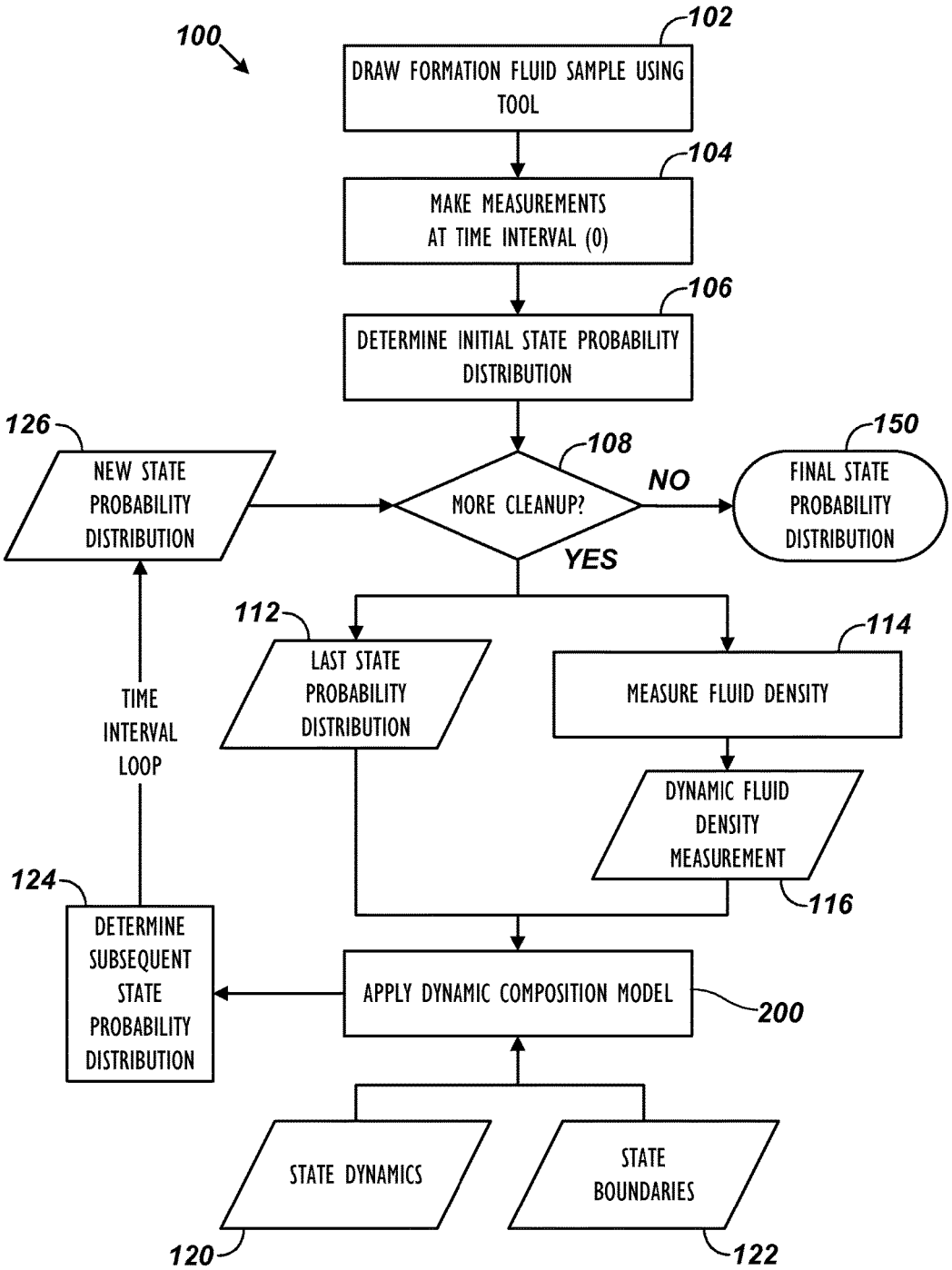
FIGS. 2A-2B illustrate flow diagrams of the fluid composition analysis according to the present disclosure.
Figure 2B:
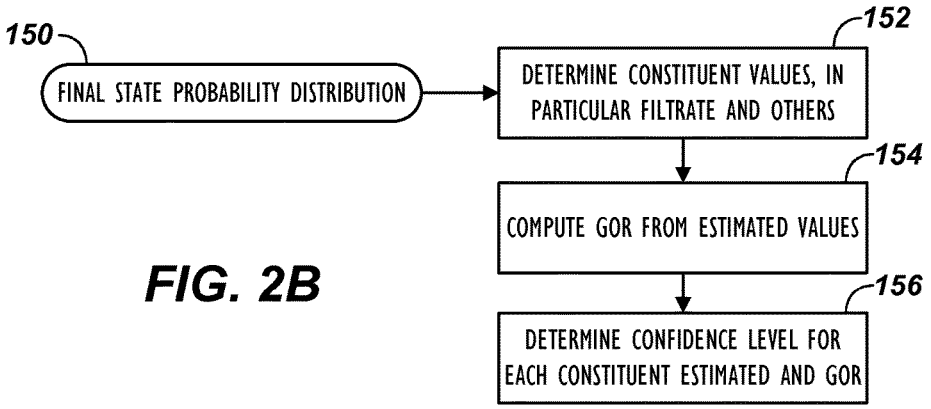

FIGS. 2A-2B show flow diagrams of the real-time fluid composition analysis according to the present disclosure, providing the analytical and algorithmic details of the disclosed analysis.

As illustrated in FIGS. 2A-2B, the real-time fluid composition analysis 100 is a continuous process that occurs as the borehole tool (10) operates at a given location in the borehole. The borehole tool (10) draws a sample of formation fluid using its probe (50) (Block 102). As this occurs, the sampled fluid goes through cleanup as it is pumped, which clears out any filtrate initially encountered. As the sample is drawn, the analysis module (20) makes measurements and monitors the density value of the fluid at fixed time intervals or ticks.

During the initial fluid draw, sensor measurements are made at an initial time interval (time t=0) defining the initial starting composition (Block 104). Then, an initial state probability distribution is obtained from this initial starting composition (Block 106). Typically, this distribution information would indicate that the current fluid state is composed entirely (or almost entirely) of the contamination component. Then, the analysis in FIG. 2A follows a time interval loop (Blocks 108 to 126). At every time interval, some amount of cleanup takes place (Block 108), the tool 10 measures the density (Block 114) to obtain a new density measurement 116 of the cleaned up fluid. A dynamic composition model is then applied (Block 200) to the previous state probability distribution 112, the constants of the state dynamic constraints 122 and boundary constraints 122, and the dynamic density value 116 (Block 200). This stage (Block 124) determines a new state probability distribution 126 for the current time interval. The analysis 100 then repeats as long as cleanup occurs.

Thus, at every time interval, the analysis 100 estimates a probability distribution of the fluid, which is expressed via its first two moments (mean vector and covariance matrix) of the fluid and which as noted above is represented by a state vector comprising all presumed constituents (e.g., gas, oil, water, filtrate, hydrocarbon, or the most elemental constituents if desired). In this sense, the distribution's mean value for a given constituent of the fluid at a given time interval estimates what amount of the sample is comprised of that constituent. The covariance matrix allows confidence levels to be inferred for each estimate, given an assumption of a particular distribution model (note, however, that the analysis framework is not bound to any particular distribution model assumption).

This time loop terminates when it is decided that no more cleanup is needed (No at Decision 108). The decision to terminate cleanup is made by observing the state probability distribution 126 at the current time interval and determining whether the distribution 126 indicates a sufficiently low contamination level. In a practical implementation, some level of contamination is acceptable. In any event, results of the recursive analysis framework yield a final state probability distribution (Block 150).

Based on the final state probability distribution, the analysis 100 can perform additional processing as shown in FIG. 2B. In particular, the processing of the results (Block 150) can determine the constituents of the fluid (Block 152), can compute the gas-to-oil ratio (GOR) (Block 154), and can determine other properties of interest. Finally, the analysis 100 can determine a confidence level for each constituent estimated and functions thereof (e.g., fluid properties, such as GOR) (Block 156). For example, in one implementation, the constituents that can be determined include supercritical gas, oil, water, hydrocarbon, and mud filtrate. However, the disclosed analysis 100 is not limited to only these constituents and can further determine detailed gas composition (methane, ethane, propane, etc.) and hydrocarbon constituents and the like, as fully noted herein. In fact, even though the present disclosure focuses on evaluating single-phase constituents of filtrate contaminant, water, supercritical gas, liquid hydrocarbon, and the like, the teachings of the present disclosure can apply equally to evaluating multi-phase constituents, which can be achieved with an appropriate density sensor capable of multiphase density measurements.

As shown in FIGS. 2A-2B, the composition analysis 100 follows an online recursive framework in which the state probability distribution at the previous time interval is used (in conjunction with the constant constraints and the dynamic observation) to produce an updated state probability distribution for the following time interval.

2. Recursive Composition Model

Figure 3:
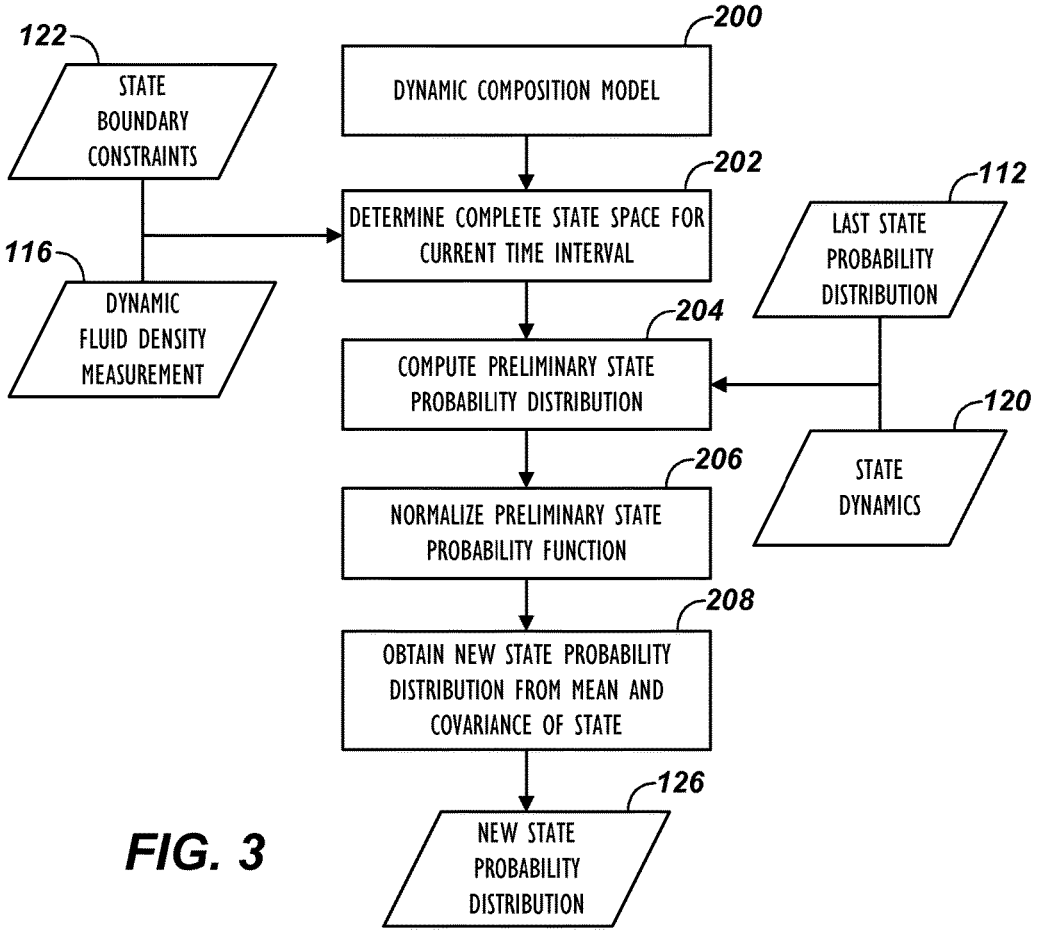
FIG. 3 illustrates a flow diagram of the composition model of the disclosed analysis.

With an understanding of the analysis presented above, discussion now turns to the computational details of applying the composition model shown as step (200) in FIG. 2A. Turning to FIG. 3, the composition model 200 takes as input: (a) the last state probability distribution 112 (from the previous time interval), (b) the measured fluid density 116, (c) the state boundary constraints 122, and (d) the state dynamics 120. By assimilating (i.e., integrating) all four inputs 112, 116, 122, and 120 dynamically, the composition model 200 then outputs the new state probability distribution 126 for the current time interval.

According to the present disclosure, the state probability distribution 112/126 is represented by its first two-order moments—i.e., mean vector and covariance matrix (though the framework is not inherently restricted to only two moments). Therefore, the composition model 200 computes the mean vector and covariance matrix of the probability distribution of the fluid's state $f_k$ (at time interval k). To do this, the model 200 must, in part, determine the complete state space $P_k$ for the time interval k (Block 202). The complete state space $P_k$ is the polyhedron or the state space of the fluid's current state $f_k$ and is defined by the measured fluid density 116 and the state boundary constraints 122.

Knowing the state probability distribution of the previous state $f_{k-1}$ (i.e., the last state probability distribution 112) and the state dynamics 120, a preliminary state probability distribution is computed at time interval k by fusing the last state probability distribution 112 and the state dynamics 120 (Block 204). This preliminary state probability distribution is then normalized with respect to the complete state space $P_k$ defined by the measured fluid density 116 and the state boundary constraints 122 (Block 206). Normalization then gives the mean and covariance of the current state $f_k$, from which the new state probability distribution 126 is obtained (Block 208).

Figure 4:
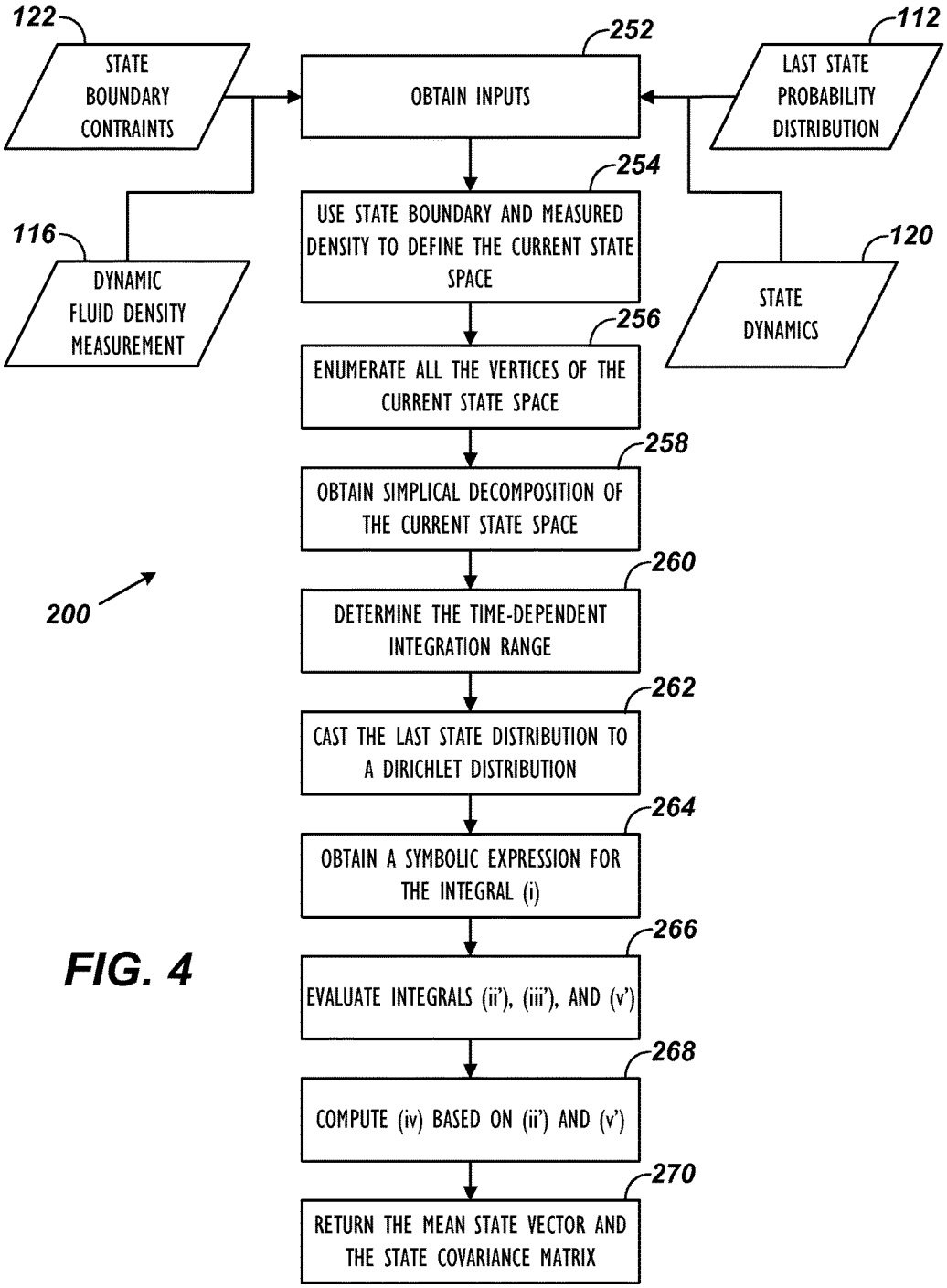
FIG. 4 illustrates a flow diagram of the composition model of the disclosed analysis in more detail.

FIG. 4 shows the composition model 200 in even more detail. Initially, the model 200 obtains the needed inputs (Block 252), which include the state dynamics 120, the state boundary constraints 122, the measured fluid density 116 at the current time interval k in the cleanup ($\rho_k$), and the last state distribution 112 (i.e., the first two moments: $\hat{f}_{k-1}$ and $\Sigma_{k-1}$). The model 200 then defines the current state space $P_k$ for the current time interval using the state boundary constraints 122 and the measured density 116 (See Sections B.2 and B.3 above) (Block 254). All vertices of the current state space $P_k$ are enumerated (See Appendix A) (Block 256), and the simplicial decomposition of the current state space $P_k$ is obtained by triangulating the current state space $P_k$ based on the enumerated vertex set (See Appendix B) (Block 258).

As will be described in more detail below, the range $\alpha_k$ and $\beta_k$ of the time-dependent integration is computed (Block 260), and the last state distribution 112 is cast as a Dirichlet distribution (Block 262), although the distribution can be cast to any type of distribution, such as Gaussian or the like. A symbolic expression for the probability function (i) below is obtained using Taylor series approximation of the Beta distribution (See Appendix C) (Block 264). Then, equation (ii') of the mean state vector, equation of the normalizing constant, and equation (v') of the expectation expression below are evaluated using a simplicial decomposition, the symbolic expression, and monomial integration formulae over simplexes (See Appendix D) (Block 266). Finally, the equation (iv) of the covariance matrix below is then computed based on the equation (ii') of the mean state vector and the equation (v') of the expectation expression below (Block 268) so that finally the mean state vector $f_k$ from equation (ii') below and the covariance matrix $\Sigma_k$ from equation (iv) below can be returned (Block 270).

The initial step (Block 254) involves computing a preliminary state probability distribution from the last state probability distribution 112 and the state dynamics 120. The state dynamics 120 define the heuristic by which the eventual state vector $f$ may potentially evolve from one time interval to another. For instance, knowing the value of the contamination fraction at the previous time interval k−1, it may be assumed that any value for the current state $f_k$ is equally probable if the value of its contamination constituent $f_{k,c}$ is within 90% to 100% of the previous contamination constituent $f_{k-1,c}$, or more generally within α% to β% of the previous contamination constituent $f_{k-1,c}$. Hence, the preliminary state probability distribution at time interval k is uniform given the value of previous contamination constituent $f_{k-1,c}$. However, the last state probability distribution 112 indicates that the previous state $f_{k-1}$ obeys a well defined state probability distribution and by implication so does the previous contamination constituent $f_{k-1,c}$.

To capture the variability of the previous contamination constituent $f_{k-1,c}$ in deriving the preliminary state probability distribution for the current state $f_k$, the conditional probability rule can be used to write the following:

$$p(f_k \wedge f_{k-1,c}) = p(f_k | f_{k-1,c}) p(f_{k-1,c})$$

Here, $p(f_k \wedge f_{k-1,c})$ is the joint probability of the current state $f_k$, and the previous contamination constituent $f_{k-1,c}$. Additionally, $p(f_k | f_{k-1,c})$ is the probability of the current state $f_k$ conditioned on the previous contamination constituent $f_{k-1,c}$ (given by the state dynamics 120). Also, $p(f_{k-1,c})$ is the probability of the previous contamination constituent $f_{k-1,c}$ (obtained from the last state probability distribution 112).

Using the law of total probability, the probability function for the current state $f_k$ may be written as follows:

$$p(f_k) = \int_{Proj_c(P_{k-1})} p(f_k \wedge f_{k-1,c}) df_{k-1,c} = \int_{Proj_c(P_{k-1})} p(f_k | f_{k-1,c}) p(f_{k-1,c}) p(f_{k-1,c}) df_{k-1,c}$$

where, $Proj_c(P_{k-})$ is the span of the contamination constituent obtained by projecting the complete space $P_{k-1}$ onto the c dimension, which corresponds to the contamination variable. Because the above probability function for the current state $f_k$ is preliminary (in the sense that it does not yet account for the current state space $P_k$), it can be denoted as $p_{prelim}(f_k)$. Hence, the last state probability distribution 112 and the state dynamics 120 yield:

$$p_{prelim}(f_k) = \int_{Proj_c(P_{k-1})} p(f_k | f_{k-1,c}) p(f_{k-1,c}) df_{k-1,c}$$

The expression of the above integrand can be further simplified. Since $P(f_k | f_{k-1,c})$ is either constant (uniform distribution) or zero depending on the values of $f_k$, $f_{k-1,c}$, α, and β, the probability function may simply be written as:

$$p_{prelim}(f_k) = \int_{\alpha_k \le f_{k-1,c} \le \beta_k} \frac{p(f_{k-1,c})}{(\beta - \alpha) f_{f-1,c}} df_{k-1,c} \quad \text{(i)}$$

where, $$\frac{1}{(\beta - \alpha) f_{k-1,c}}$$

is the uniform probability density value of $p(f_k | f_{k-1,c})$ when $\alpha f_{k-1,c} \le f_{k,c} \le \beta f_{k-1,c}$ (it is zero outside that interval). The ranges $[\alpha_k, \beta_k]$ is the time-dependent integration range over the previous contamination constituent $f_{k-1,c}$. The dynamic integration range depends on the polyhedron $P_{k-1}$, α, β, and $f_{k,c}$. It is easy to verify that the integration range $$[\alpha_k, \beta_k] = \left[\frac{f_{k,c}}{\beta}, \frac{f_{k,c}}{\alpha}\right] \cap Proj_c(P_{k-1}).$$

In fact, the $Proj_c(P_{k-1})$ term can be discarded, which allows to the range $$[\alpha_k, \beta_k] = \left[\frac{f_{k,c}}{\beta}, \frac{f_{k,c}}{\alpha}\right]$$

because $p(f_{k-1,c})$ is by definition equal to zero outside $Proj_c(P_{k-1})$. Thus, the $Proj_c(P_{k-1})$ information does not have to be fed to the next time interval iteration, which minimizes the input required as indicated in the framework in FIGS. 2A-2B.

The last formulation of $p_{prelim}(f_k)$ gets around the piecewise definition of $p(f_k|f_{k-1,c})$ by discarding the range for which it is equal to zero.

Turning to the normalization step 206 of FIG. 3 (which assimilates the information of the current state space $P_k$), computing the mean state vector $\hat{f}_k=E[f_k]$ can be written as:

$$\hat{f}_k = E[f_k] = \frac{1}{N}\int_{P_k} f_k\, p_{prelim}(f_k)\,df_k \tag{ii}$$

where N is a normalizing constant—i.e., $N=\int_{P_k} p_{prelim}(f_k)\,df_k$ (iii).

Similarly, the covariance matrix $\Sigma_k$ for the state vector $f_k$ can be computed as follows:

$$\Sigma_k=[\mathrm{Cov}(f_{k,i},f_{k,j})]_{i=1\ldots d,j=1\ldots d}= [E[f_{k,i}f_{k,j}]-\hat{f}_{k,i}\hat{f}_{k,j}]_{i=1\ldots d,j=1\ldots d} \tag{iv}$$

where d is the number of constituents (problem dimension). Here, $f_{k,i}$ represents the $i^{th}$ constituent in the state vector $f_k$, and $\hat{f}_{k,i}$ is its mean value (analogously for $f_{k,j}$ and $\hat{f}_{k,j}$). Similar to the previous expectation expression, $E[f_{k,i}f_{k,j}]$ can be calculated as follows:

$$E[f_{k,i}f_{k,j}] = \frac{1}{N}\int_{P_k} f_{k,i}f_{k,j}\,p_{prelim}(f_k)\,df_k \tag{v}$$

The estimate for $f_k$ can be chosen as its mean value $\hat{f}_k$. Note that such an estimate can be interpreted as the center of mass of a polyhedral solid where the mass is distributed according to the function $p_{prelim}(\ )$. In addition to the fixed-point estimate, arbitrary confidence intervals on the estimate may be obtained by exploiting $p(f_k)$. Moreover, the mean value and confidence intervals on values of functions of two or more constituent fractions (e.g., GOR) can be calculated by the aid of the $p(f_k)$ information (See Section D).

The foregoing description has formulated the appropriate integrals needed to compute the first two-order moments of the state probability distribution $p(f_k)$. In the next two subsections, discussion turns to (a) design choices for the probability distribution model that will be computed using only the first two-order moments and (b) suitable techniques for integrating over polyhedra.

a) Distribution Model

The disclosed framework is not theoretically bound to any particular distribution model (e.g., Gaussian, Exponential, etc.). In one implementation, the Dirichlet probability can be used to model the data distribution. The main reason for this choice is twofold. First, the Dirichlet distribution can be completely specified via its first two moments, which allows for fast computation and a compact representation. Second, the Dirichlet distribution has the standard simplex as its input domain, making it a natural choice for this problem.

The Dirichlet distribution is the multidimensional generalization of the beta distribution. A parameter vector $\alpha=\langle \alpha_i\rangle_{i=1\ldots d}$ completely characterizes this multivariate distribution and defines the shape and density of the distribution over the (d−1)-simplex domain, where d is the number of variables (components). The parameter vector α correlates directly to the first two-order distribution moments and represents the distribution variation among the d components. The probability density function for the Dirichlet Distribution for an input $x=\langle x_i\rangle_{i=1\ldots d}$ and a parameter $\alpha=\langle \alpha_i\rangle_{i=1\ldots d}$ is expressed as follows:

$$f_\alpha(x_1,\ldots,x_d) = \frac{1}{B(\alpha)}\prod_{i=1}^{d} x_i^{\alpha_i-1}$$

where, $$\begin{cases} \mathrm{Var}[X_i] = \dfrac{E[X_i](1-E[X_i])}{\alpha_0+1} & \text{(vii)} \\ \mathrm{Cov}[X_i, X_j] = \dfrac{-E[X_i]E[X_j]}{\alpha_0+1},\ i\neq j & \text{(viii)} \end{cases}$$

is the multinomial beta function and $\Gamma(\alpha_i)=\int_0^\infty t^{\alpha_i-1}e^{-t}dt$ is the Gamma function.

The first distribution moment (mean vector) for a Dirichlet-distributed d-dimensional variable X can be expressed in terms of the α vector as follows.

$$B(\alpha) = \frac{\prod_{i=1}^{d}\Gamma(\alpha_i)}{\Gamma\left(\sum_{i=1}^{d}\alpha_i\right)}$$

where, $\alpha_0=\Sigma_{i=1}^{d}\alpha_i$.

The second distribution moment or the covariance matrix can be expressed in terms of the first moment and the α vector as follows:

$$E[X] = \langle E[X_i]\rangle_{i=1\ldots d} = \left\langle \frac{\alpha_i}{\alpha_0}\right\rangle_{i=1\ldots d} \tag{vi}$$

When X is Dirichlet-distributed, each component $X_i$ of X obeys a beta distribution with shape parameters $\alpha_i$ and $\alpha_0-\alpha_i$. Particularly, the probability density function $p(f_{k-1,c})$ for the distribution of the contamination component used in the computation of the preliminary state probability distribution becomes that of a beta distribution following the assumption of a Dirichlet-distributed $f_k$.

Note that $p(f_{k-1,c})$ is the only distribution information that is propagated into the recursive computation of future state distributions. Hence, potential propagated errors are only the ones induced by the beta distribution model and not by the whole Dirichlet state model. The complete state distribution model is only needed to infer confidence intervals on each estimated fraction for a given time interval because only the contamination distribution model is used for subsequent time intervals.

Once the first two-order moments are computed using the above equations (i)-(v), casting the state distribution to the Dirichlet model reduces to obtaining the α vector. To compute α, it suffices to compute $\alpha_0$ and then use equation (vi) of the first distribution moment above to obtain each of the $\alpha_i$ components. To compute $\alpha_0$, note that each equation in the two sets (vii) and (viii) of the second distribution moment or the covariance matrix gives one possible value for $\alpha_0$. To resolve the over-determined system in terms of $\alpha_0$, one might use simple linear regression to minimize the sum of squares. The least squares error provides a measure for assessing the accuracy of the Dirichlet model.

b) Integration Over Polyhedra

The normalization step mentioned in subsection a) above requires that integration be done over a polyhedron state space. Accordingly, the sampling-based and analytical approaches to evaluating the integral (ii) of the mean state vector, the integral (iii) of the normalizing constant, and the integral (v) of the expectation expression in Section C above are now discussed.

(1) Sampling-Based Integration

The simplest way to integrate a function over a polyhedron is to approximate the surface integral by sampling a sufficient number of points from the polyhedral surface, evaluating function values of the sampled points, and approximating the integral by the aid of a finite Riemann sum. The polyhedral surface can be represented in terms of a constrained mixture design, which allows standard constrained mixture design methods to be used to sample from the polyhedral surface according the desired granularity. Other sampling techniques from the polyhedron are possible, such as space-projection sampling using Linear Programming.

(2) Analytical Integration

In one implementation, an analytical approach can be used to evaluate equation (i) of the probability function, equation (iii) of the normalizing constant, and equation (v) of the expectation expression in Section C.2 above. Here, a simplicial decomposition of the polyhedral surface is performed, each integral of interest is evaluated over each simplex in the decomposition, and finally the integration results are summed over all simplexes to yield the result of each of the original polyhedral integrals.

The simplicial decomposition involves two steps. In a first step (1), an enumeration is performed of all vertices of the polyhedral surface. In a second step (2), a triangulation approach is applied on the vertex set obtained from the first step (1) to yield the simplicial decomposition.

By virtue of this simplicial decomposition approach, the integral (ii) of the mean state vector, the integral (iii) of the normalizing constant, and the integral (v) of the expectation expression in Section C.2 can be rewritten as follows (where a denotes a simplex):

$$\hat{f}_k = E[f_k] = \frac{1}{N}\sum_{\sigma\in P_k}\int_\sigma f_k\, p_{prelim}(f_k)df_k \tag{ii'}$$

$$N = \sum_{\sigma\in P_k}\int_\sigma p_{prelim}(f_k)df_k \tag{iii'}$$

$$E[f_{k,i}f_{k,j}] = \frac{1}{N}\sum_{\sigma\in P_k}\int_\sigma f_{k,i}f_{k,j}\, p_{prelim}(f_k)df_k \tag{v'}$$

To this end, the evaluation of the integrands in above equation (ii') of the mean state vector, equation (iii') of the normalizing constant, and equation (v') of the expectation expression over a simplex remains an issue. This is because $p_{prelim}(f_k)$ depends on the chosen distribution model, as does the complexity of the above integrals. To get around this difficulty and simultaneously standardize the problem's complexity, it is proposed to approximate any distribution model by its Taylor series expansions. Taylor series are sums of monomial functions so integration is linear in terms of the addition operation. All of the integrations will reduce to integrations of monomials over simplexes. The formulae for integration of monomials over simplexes are known in the art and are shown in Appendix D for reference.

This completes the description of the composition model 200 of the present disclosure. As noted above, additional details are provided in the attached Appendices—e.g., for performing the Taylor series expansion (Appendix A), the polyhedron vertex enumeration (Appendix B), the polyhedron triangulation (Appendix C), and the integration of monomials over simplexes (Appendix D).

D. Inferences of Properties of Interest

1. Contamination Estimate and Probabilistic Intervals

As noted above, the probability distribution can be used to estimate the contamination of the fluid sample. In particular, the probability distribution of the contamination constituent at a time interval k is directly represented by $p(f_{k,c})$, which is a Beta distribution in the particular implementation based on the assumption of a Dirichlet distribution for the dynamic state vector. The estimate of the contamination is thus directly given by $\hat{f}_{k,c}$.

The probability over any desired confidence intervals (say [a, b]) can be evaluated as:

$$Prob(f_{k,c})_{a,b} = \int_a^b p(f_{k,c})df_{k,c}$$

Again, Taylor series approximation (See Appendix C) can be used to approximate the above integrand. Use of the Taylor series approximation allows the integral to be evaluated analytically in order to determine a confidence level for contamination within a certain range of a to b percent.

2. GOR Estimate and Probabilistic Intervals

As also noted above, the probability distribution can be used to estimate the gas-to-oil ratio (GOR) of the fluid sample. In particular, the probability distribution of the GOR can be calculated to provide a GOR estimate and GOR confidence intervals. Recall that the GOR is the volumetric ratio of the sum of the vapor phase gas constituent volumetric fractions divided by the sum of liquid hydrocarbon constituent volumetric fractions. If G denotes the set of all gas constituents and O denotes the set of all oil constituents, then at time interval k, GOR can be written as:

$$GOR_k = \frac{\sum_{g\in G} f_{k,j}}{\sum_{o\in O} f_{k,o}}$$

Clearly, $GOR_k$ is a random variable, and its mean value can be computed as follows:

$$\widehat{GOR}_k = m_1 = \int_{P_k} p(f_k)\frac{\sum_{g\in G} f_{k,g}}{\sum_{o\in O} f_{k,o}}df_k$$

The above equation can be rewritten in terms of the simplicial decomposition as follows:

$$\widehat{GOR}_k = m_1 = \sum_{\sigma\in P_k}\int_\sigma p(f_k)\frac{\sum_{g\in G} f_{k,g}}{\sum_{o\in O} f_{k,o}}df_k$$

Similarly, higher order moments of the distribution of $GOR_k$ can be expressed as below:

$$m_i = \sum_{\sigma \in P_k} \int_{\sigma} p(f_k) \left( \frac{\sum_{g \in G} f_{k,g}}{\sum_{o \in O} f_{k,o}} - m_1 \right)^i df_k$$

where $m_i$ denote the $i^{th}$ moment of $GOR_k$. The integrand in $m_i$ is approximated using the Taylor series expansion detailed in Appendix A. Refer to Appendices A-D for computing $m_i$.

The distribution of the $GOR_k$ variable can be approximated via the set of the first m moments (e.g., using the Pearson system with the first 4 moments). Using this moment-based approach, an approximation can be obtained for the probability density function $p(GOR_k)$ of the gas-to-oil ratio $GOR_k$ at time interval k.

Arbitrary confidence intervals (for example [a, b]) for $GOR_k$ can now be obtained in similar fashion as with the contamination constituent described above.

$$Prob(GOR_k)_{a,b} = \int_a^b p(GOR_k) dGOR_k$$

E. Dimension Reduction

So far, the analysis 100 has assumed the complete fluid composition (i.e., exhaustive of all possible constituents). When the computations are performed in real-time with the downhole tool 10 in the borehole or at least if downhole measurements are communicated to the surface for processing, the analysis 100's time complexity can be lowered by effectively reducing the problem dimension—i.e., the number of presumed constituents. Characterizing the chance of the existence of every possible constituent in the formation fluid may be of little use, especially when some of the more critical components in the reservoir's fluid composition are the contaminant, water, supercritical gas, and liquid hydrocarbon.

Accordingly, the analysis 100 can be optimized in terms of the problem dimension by abstracting relevant constituents into a gas mixture component and an oil (crude) mixture component in addition to the water and the contaminant components. This reduces the problem's dimension to four (i.e., gas, oil, water, and contaminant). As will be appreciated, alternative fluid composition abstractions are possible, and the dimension reduction approach discussed below can apply to any chosen abstraction.

Of particular note, the individual densities for the gas and oil mixtures are no longer constants. Because the state boundary constraints (122) are constant (Section B.3 above), their incorporation can be predetermined to obtain distributions for the individual fluid densities for the gas and oil mixtures. In particular, for every gas mixture within the boundary constraints, a different density value can be obtained for the mixture. Accounting for all possible gas mixtures that satisfy the boundary constraints yields a fluid density distribution for the gas mixture that can then be stored in memory 74 of the tool 10 in any relevant format for reference during processing.

In the absence of any prior information, any gas mixture satisfying the boundary constraints can be assumed equally probable. The same idea is applicable to oil mixtures satisfying the boundary constraints. The assumption of equiprobability does not contradict the previous developments in Sections B-C above. Rather, the state boundary constraints (122) are moved out of the online computations. In fact, to obtain the offline mixture density distributions for gas and oil, the density space has to be integrated over a polyhedron. Only in this case, the polyhedron solid is uniformly distributed.

Integration over polyhedra can be done as discussed previously via simplicial decomposition. This time, the integrand is much simpler (the expression for the mixture fluid density). Alternative numerical approaches can be used to compute the mixture density distribution, and one possible approach is discussed below in Appendix E.

Because the computations in Sections B-D assume constant density values for each component, the variability of the gas and oil mixture densities need to be accounted for. To do this, the analysis uses model averaging using the definition of conditional probability and total probability law.

Under the assumption of variable gas and oil densities, the calculations (at the end of Section D) include the conditional probability density functions i.e., $p(f_{k,c}|\rho_g, \rho_o)$ and $p(GOR_k|\rho_g,\rho_o)$ as opposed to $p(f_{k,c})$ and $p(GOR_k)$ indicated previously. That is, given fixed density values for gas and oil mixtures i.e., $\rho_g$ and $\rho_o$, the conditional probability functions of $f_{k,c}$ and $GOR_k$ can be obtained using the techniques discussed above in Section D. To then infer the actual probabilities $p(f_{k,c})$ and $p(GOR_k)$, the total probability law can be used as follows:

$$p(f_{k,c}) = \int_{\rho_g} \int_{\rho_o} p(f_{k,c} | \rho_g, \rho_o) p(\rho_g, \rho_o) d\rho_g d\rho_o$$

Because $\rho_g$ and $\rho_o$ are independent, $p(\rho_g, \rho_o)=p(\rho_g)p(\rho_o)$ which then gives:

$$p(f_{k,c}) = \int_{\rho_g} \int_{\rho_o} p(f_{k,c} | \rho_g, \rho_o) p(\rho_g) p(\rho_o) d\rho_g d\rho_o$$

The functions $p(\rho_g)$ and $p(\rho_o)$ are obtained offline by the description of the previous procedure mentioned in this Section. For each set of values of $\rho_g$ and $\rho_o$, the techniques in Sections B-D give $p(f_{k,c}|\rho_g, \rho_o)$. To evaluate the last double integral over the space of $\rho_g X \rho_o$, an infinite number of runs would be needed to compute every possible $p(f_{k,c}|\rho_g,\rho_o)$. To get around this issue, the last double integral is approximated using finite sums to yield the following:

$$p(f_{k,c}) \approx \sum_{\rho_g} \sum_{\rho_o} p(f_{k,c} | \rho_g, \rho_o) p(\rho_g) p(\rho_o) \Delta\rho_g \Delta\rho_o$$

where $\Delta\rho_g$ and $\Delta\rho_o$ are the discretization granularities over the gas density space and oil density space, respectively. The granularity level can be chosen based on an appropriate tradeoff between complexity and accuracy of approximation for $p(\rho_g)$ and $p(\rho_o)$.

An equivalent logic provides:

$$p(GOR_k) \approx \sum_{\rho_g} \sum_{\rho_o} p(GOR_k \mid \rho_g, \rho_o) p(\rho_g) p(\rho_o) \Delta\rho_g \Delta\rho_o$$

Confidence intervals can be computed by substituting the last approximations in the same expressions in Section D—i.e., $$Prob(f_{k,c})_{a,b} \approx \int_a^b \sum_{\rho_g} \sum_{\rho_o} p(f_{k,c} \mid \rho_g, \rho_o) p(\rho_g) p(\rho_o) \Delta\rho_g \Delta\rho_o df_{k,c}$$

$$\Leftrightarrow$$

$$Prob(f_{k,c})_{a,b} \approx \sum_{\rho_g} \sum_{\rho_o} p(\rho_g) p(\rho_o) \Delta\rho_g \Delta\rho_o \int_a^b p(f_{k,c} \mid \rho_g, \rho_o) df_{k,c}$$

The evaluation of the term $\int_a^b p(f_{k,c}|\rho_g,\rho_o)df_{k,c}$ is equivalent to that in Section D with fixed $\rho_g$ and $\rho_o$.

Similarly, $$Prob(GOR_k)_{a,b} \approx \sum_{\rho_g} \sum_{\rho_o} p(\rho_g) p(\rho_o) \Delta\rho_g \Delta\rho_o \int_a^b p(GOR_k \mid \rho_g, \rho_o) dGOR_k$$

Evaluating $\int_a^b p(GOR_k|\rho_g\rho_o)dGOR_k$ is done exactly as according to Section D.

F. Erroneous Density Measurement

In Section B.2 above, perfect fluid density measurements were assumed to be obtained. In reality, observational noise is common especially in a downhole environment with a tool (10), such as described previously. In fact, what is truly measured is $\rho+\varepsilon$, where $\varepsilon$ is measurement noise. A statistical characterization of $\varepsilon$ is preferably used.

One way to characterize the noise $\varepsilon$ is to assume that the noise $\varepsilon$ can be anywhere within plus or minus a certain threshold (e.g., $\pm 10^{-3}$) and that all errors within that interval are equally probable, which would correspond to uniform random noise. This assumption changes the density equation to a double inequality, but the state space remains in principle a polyhedron, which allows the same techniques disclosed above to be used with no required changes.

If the assumption of a uniform random noise is not used so that the noise $\varepsilon$ is instead characterized as behaving according to a certain probability density function $p(\varepsilon)$ (e.g., Gaussian distribution), then the noise $\varepsilon$ becomes a parameter in the same way as the gas and oil densities $\rho_g$ and $\rho_o$. For this reason, the same handling of random parameters as disclosed above in Section E can be done to further incorporate a third parameter for the noise E. Evidently, all of the parameters $\rho_g$, $\rho_o$, and $\varepsilon$ are independent so that their joint probability would be expressed as: $p(\rho_g, \rho_o, \varepsilon)=p(\rho_g)p(\rho_o)p(\varepsilon)$. As indicated in this section, consideration of measurement noise can further refine the analysis of the present disclosure.

The techniques of the present disclosure can be implemented in digital electronic circuitry, or in computer hardware, firmware, software, or in combinations of these. Apparatus for practicing the disclosed techniques can be implemented in a computer program product tangibly embodied in a machine-readable storage device for execution by a programmable processor; and method steps of the disclosed techniques can be performed by a programmable processor executing a program of instructions to perform functions of the disclosed techniques by operating on input data and generating output. The disclosed techniques can be implemented advantageously in one or more computer programs that are executable on a programmable system including at least one programmable processor coupled to receive data and instructions from, and to transmit data and instructions to, a data storage system, at least one input device, and at least one output device. Each computer program can be implemented in a high-level procedural or object-oriented programming language, or in assembly or machine language if desired; and in any case, the language can be a compiled or interpreted language. Suitable processors include, by way of example, both general and special purpose microprocessors. Generally, a processor will receive instructions and data from a read-only memory and/or a random access memory. Generally, a computer will include one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM disks. Any of the foregoing can be supplemented by, or incorporated in, ASICs (application-specific integrated circuits).

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

APPENDIX A

Polyhedron Vertex Enumeration

As noted above with reference to FIG. 4, the composition model 200 involves enumerating the vertices of the current state space $P_k$ (See Block 256 in FIG. 4). A d-dimensional polyhedron can be defined as the set of points lying within a bounding set of half-spaces where every half-space is represented by a linear inequality in d variables (i.e., half-plane). The problem of enumerating all vertices of a given polyhedron defined in terms of a set of linear inequalities has been extensively studied within the realms of the combinatorial/computational geometry and discrete computational optimization methods. Because the brute force approach to the vertex enumeration problem admits a combinatorial complexity in terms of the dimension and the number of inequalities, a myriad of algorithms have been devised in an attempt to achieve an affordable complexity.

Methods and assessment of their associated complexities are disclosed in [Matheiss et al. 1980] and [Dyer 1983]. In

[Avis et al. 1992], an efficient enumeration algorithm is proposed and was later improved by [Avis 2000]. A different approach is proposed in [Fukuda et al. 1997]. For theoretical results on the vertex enumeration problem of well-defined classes of polyhedra, see [Bremner et al. 1997] and [Kachiyan et al. 2006]. In the case of a polyhedron embedded within a simplex (as is the case of the state space P of Section B), algorithms within the mixture design literature exist for enumerating polyhedron vertices e.g., [McLean et al. 1966], [Snee et al. 1974], and [Crosier 1986].

APPENDIX B

Polyhedron Triangulation

As noted above with reference to FIG. 4, the composition model 200 involves triangulating the current state space $P_k$ based on the enumerated vertex set to obtain the simplicial decomposition of the current state space $P_k$ (See Block 256 in FIG. 4). Computational geometry provides ways to decompose arbitrary d-dimensional polyhedral solids into d-dimensional solids of simple geometrical shapes that are more manageable. Of particular interest here is the simplicial decomposition (triangulation) of polyhedral solids i.e., decomposing an arbitrary polyhedron into a set of simplexes (triangles generalized to d dimensions) whose union yields back the original polyhedron and such that any two simplexes in the decomposition are either disjoint or intersect only at a common boundary (a boundary or a face is also a simplex but of lower order (<d)).

The Delaunay triangulation is one particular type of polyhedral triangulation of great interest due its inherent duality with respect to Voronoi diagrams. The Delaunay triangulation requires that the circumcircle of any simplex in the decomposition contain only the vertices of its associated simplex on its boundary and no other points (vertices of other simplexes) in either its interior or boundary.

Various methods can be used to solve the general Delaunay triangulation problem for d dimensions. For the decomposition problem of the present disclosure, a slightly modified version of the Delaunay triangulation algorithm for d-dimensional polyhedra proposed in [Cignoni et al. 1998] can be used. Here, an arbitrary triangulation is sufficient, much of the computation in the algorithm of [Cignoni et al. 1998] needed to maintain the Delaunay property can be avoided and improve the complexity of constructing the final triangulation (no vertex point optimization is needed for constructing the new simplex to be added into the decomposition). Though the final triangulation in turn might influence the complexity of solving our estimation problem, this issue is not addressed as per the current implementation (i.e., the current implementation may be only concerned with optimizing the time complexity of generating the output triangulation and not that of the output triangulation itself).

APPENDIX C

Taylor Series Approximation of the Beta Distribution

As noted above with reference to FIG. 4, the composition model 200 involves using Taylor series approximation of the Beta distribution to obtain a symbolic expression for the probability function (i) (See Block 262 in FIG. 4). The Taylor series representation for a function $f$ (x) around a fixed point a is the infinite polynomial series in x where the polynomial coefficients are functions of the derivatives of $f$ with respect to x evaluated at a. Precisely, $$f(x) = \sum_{n=0}^{\infty} \frac{\frac{d^n f(a)}{dx^n}}{n!}(x-a)^n$$

A function $f$ is often approximated by its Taylor series of order k i.e., truncated after the $k^{th}$ term. This is applied to provide a Taylor series approximation for the probability density function of the Beta distribution. The probability density function p(x) for the Beta distribution is given by:

$$p(x) = \frac{x^{\alpha-1}(1-x)^{\beta-1}}{B(\alpha, \beta)}$$

with $B(\alpha,\beta)=\int_0^1 u^{\alpha-1}(1-u)^{\beta}du$.

To be able to apply the Taylor series approximation for the Beta distribution density function, the $n^{th}$ derivative of p(x) needs to be evaluated.

Let $q(x)=x_{\alpha-1}(1-x)^{\beta-1}$ and $$\frac{d^n q(x)}{dx^n} = D(n, \alpha, \beta, x).$$

Then, $$\frac{d^n p(x)}{dx^n} = \frac{D(n, \alpha, \beta, x)}{B(\alpha, \beta)}.$$

It is easy to verify that $D(1, \alpha, \beta, x)=(\alpha-1)x^{\alpha-2}(1-x)^{\beta}-(\beta-1)x^{\alpha-1}(1-x)^{\beta-2}$ and that the below recursive relation is satisfied.

$$D(n,\alpha,\beta,x)=(\alpha-1)D(n-1,\alpha-1,\beta,x)-(\beta-1)D(n-1,\alpha,\beta-1,x)$$

Hence, the coefficients in the Taylor series approximation for p(x) may be evaluated iteratively starting from the lowest order coefficient in ascending order up to the coefficient of order k.

APPENDIX D

Integration of a Monomial Over a Simplex

As noted above with reference to FIG. 4, the composition model 200 involves computing integrals of monomials over simplexes (See Block 266 in FIG. 4). To compute the integral of a monomial over a standard simplex, the formula published in [Bernardini 1991] can be used.

If $\hat{\sigma}$ is a d-dimensional standard simplex and $u_1^{h_1}u_2^{h_2} \ldots u_d^{h_d}$ is a monomial in $R^d$ with $\{h_1, h_2, \ldots, h_d\}$ being integer exponents then:

$$\int_{\hat{\sigma}} u_1^{h_1} u_2^{h_2} \ldots u_d^{h_d} du_1 du_2 \ldots du_d = \frac{\prod_{i=1}^{d} h_i!}{\left(\sum_{i=1}^{d} h_i + d\right)!}$$

If the integration space is a non-standard simplex then appropriate coordinate transformation must be applied to transform it into a standard simplex.

APPENDIX E

Numerical Evaluation of Density Distributions

As noted above, the composition model 200 involves evaluating the mixture density distribution—one possible approach being discussed here. Let $\rho^{inv,d}=(\rho_1\rho^{-1}, \ldots, \rho_d\rho^{-1})$ be $\alpha$ vector in $R^d$ representing the fluid density of d chemical components multiplied by the inverse of the density of their mixture ($\rho^{-1}$). Let $R_i$ be a range in [0,1] for i=1 . . . d representing the expected volume fraction range for the $i^{th}$ chemical component. Let $\sigma$ be the standard simplex in $R^d$. Let $f$ be $\alpha$ vector in the polyhedron space P defined by the intersection of $\sigma$ and $\{R_i\}_{i=1 \ldots d}$. $f$ denotes in fact the set of volume fractions for all of the d components. The desire is to compute the distribution of the average mixture fluid density $\overline{\rho}=\rho^{inv,d}\cdot f$ of the d-component composition over P assuming every point in P is equally probable. The distribution will be represented via its moments. This appendix develops explicit formulae for the first 4 moments, the same principle generalizes to the $k^{th}$ moment.

The forthcoming approach shown in this appendix is numerical. The idea is to evaluate the distribution of $\overline{\rho}$ based on a fixed set of points in P. The size of the sample set from P depends on a chosen granularity. However, every sample point does not need to be generated in order to compute the distribution moments. A well-chosen sample space can help develop recursive formulae for the distribution moments that can be efficiently evaluated i.e., with time complexity much less than the order of the sample size.

Discretize P by discretizing every $R_i$ based on a fixed uniform granularity (in the literature of mixture design, this may be achieved via a simplex-lattice design). For instance, if $R_{i_0}$=[0.1,0.2] and the discretization granularity is 0.01 then the discretized range for $R_{i_0}$ would be {0.1,0.11,0.12,0.13, 0.14,0.15,0.16,0.17,0.18,0.19,0.2}. With this discretization scheme, the problem can be mapped to that of a constrained integer composition in d terms. An integer composition of n in d terms is any possible permutation of d integers that sums up to n. A constrained integer composition is an integer composition with constraints imposed on the range of each term. To elaborate, the range $R_{i_0}$ would be equivalent to {10,11,12,13,14,15,16,17,18,19,20} and the sum of all fractions (i.e., $f_i$) would change from 1 to 100. The mapping is realized by multiplying all numbers by $$\frac{1}{0.01}$$

or the inverse of the granularity. More intuitively, every sample point in P can be made equivalent to one number composition of 100 of d terms as per this example. Hence in general, the sample size with this discretization scheme is on the order of all possible number compositions of $$\frac{1}{\text{granularity}}$$

in d terms.

Let $C_{\alpha_j,\beta_j}(i,j)$ be the number of all possible constrained compositions of the integer i into j terms where $\alpha_j$ is the vector of the lower limits of the j terms and $\beta_j$ is the vector of the upper limits of the j terms. It can be clearly verified that $C_{\alpha_1,\beta_1}(i,1)=$ $$\begin{cases} 1 & \text{if } \alpha_1 \le i \le \beta_1 \\ 0 & \text{otherwise} \end{cases}.$$

Plainly put, there is exactly one composition of any integer into exactly one term if the limits are satisfied and none if not.

It can also be verified that $C_{\alpha_j,\beta_j}(i,j)=\Sigma_{k=\alpha_{j,j}}^{min(\beta_{i,j},i)} C_{\alpha_{j-1},\beta_{j-1}}(i-k, j-1)$ where $\alpha_{j,j}$ and $\beta_{j,j}$ are the $j^{th}$ components in the $\alpha_j$ and $\beta_j$ vectors, respectively, and min( ) is the minimum function. That is to say that the composition function C admits an intuitive recursive relation by virtue of the fact that every composition of an integer n into j terms can be obtained from every composition of n−k into j−1 terms and k as the $j^{th}$ term. An open-source code for an example implementation of the C function may be found at [Bottomley 2004].

The C function will be needed to evaluate the moments of the distribution of $\overline{\rho}$ over P. Let S(P) be the sample space from P, the $k^{th}$ sample moment of $\overline{\rho}$ can be written as follows.

$$m_k = \frac{\sum_{f\in S(P)} (\rho^{inv,d}\cdot f)^k}{|S(P)|} = \frac{\sum_{f\in S(P)} (\rho^{inv,d}\cdot f)^k}{C_{\alpha_d,\beta_d}\left(\frac{1}{\text{granularity}}, d\right)} = \frac{S^k_{\alpha_d,\beta_d}\left(\frac{1}{\text{granularity}}, d\right)}{C_{\alpha_d,\beta_d}\left(\frac{1}{\text{granularity}}, d\right)}$$

To evaluate $m_k$, it only remains to compute the function $S_{\alpha_d,\beta_d}{}^k$. The following shows how to recursively compute the functions $S_{\alpha_d,\beta_d}{}^1$, $S_{\alpha_d,\beta_d}{}^2$, $S_{\alpha_d,\beta_d}{}^3$, and $S_{\alpha_d,\beta_d}{}^4$. The same recursive principle applies to the $k^{th}$ order.

Let $t^d=(t_1, \ldots, t_d)\in S(P)$ (i.e., $t^d$ is any possible composition). For a fixed $t_d$ ($d^{th}$ component of $t^d$) gives:

$$S^1_{\alpha_{d-1},\beta_d}\left(\frac{1}{\text{granularity}} - t_d, d-1\right) = \sum_{\substack{\sum_{i=1}^{d-1} t_i = \frac{1}{granularity} - t_d \\ t_i \in [\alpha_{d,i},\beta_{d,i}]}} \rho^{inv,d-1}\cdot t^{d-1}$$

To get $$S^1_{\alpha_d,\beta_d}\left(\frac{1}{\text{granularity}}, d\right),$$

it suffices to add one $\rho_d{}^{-1}t_d$ for every $\rho^{inv,d-1}.t^{d-1}$ term and allow $t_d$ to vary. Hence, $$S^1_{\alpha_d,\beta_d}\left(\frac{1}{\text{granularity}}, d\right) = \sum_{t_d\in[\alpha_{d,d},\beta_{d,d}]} \left( \sum_{\substack{\sum_{i=1}^{d-1} t_i = \frac{1}{granularity} - t_d \\ t_i \in [\alpha_{d,i},\beta_{d,i}]}} [\rho^{inv,d-1}\cdot t^{d-1} + \rho_d^{-1} t_d] \right) =$$

-continued $$\sum_{t_d\in[\alpha_{d,d},\beta_{d,d}]}\left(\sum_{\substack{\sum_{i=1}^{d-1}t_i=\frac{1}{granularity}-t_d\\ t_i\in[\alpha_{d,i},\beta_{d,i}]}}\rho^{inv,d-1}\cdot t^{d-1}+\sum_{\substack{\sum_{i=1}^{d-1}t_i=\frac{1}{granularity}-t_d\\ t_i\in[\alpha_{d,i},\beta_{d,i}]}}\rho_d^{-1}t_d\right)$$

Factoring $\rho_d^{-1}t_d$ out of the second inner sum, $$=\sum_{t_d\in[\alpha_{d,d},\beta_{d,d}]}\left(\sum_{\substack{\sum_{i=1}^{d-1}t_i=\frac{1}{granularity}-t_d\\ t_i\in[\alpha_{d,i},\beta_{d,i}]}}\rho^{inv,d-1}\cdot t^{d-1}+\rho_d^{-1}t_d\sum_{\substack{\sum_{i=1}^{d-1}t_i=\frac{1}{granularity}-t_d\\ t_i\in[\alpha_{d,i},\beta_{d,i}]}}1\right)$$

The second inner sum is known to have exactly $$C_{\alpha_{d-1},\beta_{d-1}}\left(\frac{1}{\text{granularity}}-t_d,\ d-1\right)$$

terms giving, $$=\sum_{t_d\in[\alpha_{d,d},\beta_{d,d}]}\left(\sum_{\substack{\sum_{i=1}^{d-1}t_i=\frac{1}{granularity}-t_d\\ t_i\in[\alpha_{d,i},\beta_{d,i}]}}\rho^{inv,d-1}\cdot t^{d-1}+\rho_d^{-1}t_dC_{\alpha_{d-1},\beta_{d-1}}\left(\frac{1}{\text{granularity}}-t_d,\ d-1\right)\right)$$

Replacing the first inner sum in terms of the S function yields finally, $$S^1_{\alpha_d,\beta_d}\left(\frac{1}{\text{granularity}},\ d\right)=\sum_{t_d\in[\alpha_{d,d},\beta_{d,d}]}\left(S^1_{\alpha_{d-1},\beta_{d-1}}\left(\frac{1}{\text{granularity}}-t_d,\ d-1\right)+\rho_d^{-1}t_dC_{\alpha_{d-1},\beta_{d-1}}\left(\frac{1}{\text{granularity}}-t_d,\ d-1\right)\right)$$

Hence, the recursive definition for $S_{\alpha_d,\beta_d}{}^1$. Note that to compute $S_{\alpha_d,\beta_d}{}^1$, only a two-dimensional array with $$\frac{1}{\text{granularity}}$$

elements for the first dimension and d elements for the second and thus a complexity of $$O\left(\frac{d}{\text{granularity}}\right)$$

which is evidently much less than the cardinality of the sample space or $$C_{\alpha_d,\beta_d}\left(\frac{1}{\text{granularity}},\ d\right)$$

needs to be computed and stored. Below shows the formulae for the second, third, and fourth order S functions needed to evaluate $m_2$, $m_3$, and $m_4$. The derivation (which is omitted for concision) is similar to the above for $S_{\alpha_d,\beta_d}{}^1$.

$$S^2_{\alpha_d,\beta_d}\left(\frac{1}{\text{granularity}},\ d\right)=\sum_{t_d\in[\alpha_{d,d},\beta_{d,d}]}\left(S^2_{\alpha_{d-1},\beta_{d-1}}\left(\frac{1}{\text{granularity}}-t_d,\ d-1\right)+(\rho_d^{-1}t_d)^2C_{\alpha_{d-1},\beta_{d-1}}\left(\frac{1}{\text{granularity}}-t_d,\ d-1\right)+2\rho_d^{-1}t_dS^1_{\alpha_{d-1},\beta_{d-1}}\left(\frac{1}{\text{granularity}}-t_d,\ d-1\right)\right)$$

$$S^3_{\alpha_d,\beta_d}\left(\frac{1}{\text{granularity}},\ d\right)=\sum_{t_d\in[\alpha_{d,d},\beta_{d,d}]}\left(S^3_{\alpha_{d-1},\beta_{d-1}}\left(\frac{1}{\text{granularity}}-t_d,\ d-1\right)+(\rho_d^{-1}t_d)^3C_{\alpha_{d-1},\beta_{d-1}}\left(\frac{1}{\text{granularity}}-t_d,\ d-1\right)+3(\rho_d^{-1}t_d)^2S^1_{\alpha_{d-1},\beta_{d-1}}\left(\frac{1}{\text{granularity}}-t_d,\ d-1\right)+3\rho_d^{-1}t_dS^2_{\alpha_{d-1},\beta_{d-1}}\left(\frac{1}{\text{granularity}}-t_d,\ d-1\right)\right)$$

$$S^4_{\alpha_d,\beta_d}\left(\frac{1}{\text{granularity}},\ d\right)=\sum_{t_d\in[\alpha_{d,d},\beta_{d,d}]}\left(S^4_{\alpha_{d-1},\beta_{d-1}}\left(\frac{1}{\text{granularity}}-t_d,\ d-1\right)+(\rho_d^{-1}t_d)^4C_{\alpha_{d-1},\beta_{d-1}}\left(\frac{1}{\text{granularity}}-t_d,\ d-1\right)+4(\rho_d^{-1}t_d)^3S^1_{\alpha_{d-1},\beta_{d-1}}\left(\frac{1}{\text{granularity}}-t_d,\ d-1\right)+6(\rho_d^{-1}t_d)^2S^2_{\alpha_{d-1},\beta_{d-1}}\left(\frac{1}{\text{granularity}}-t_d,\ d-1\right)+4\rho_d^{-1}t_dS^3_{\alpha_{d-1},\beta_{d-1}}\left(\frac{1}{\text{granularity}}-t_d,\ d-1\right)\right)$$

BIBLIOGRAPHY

The teachings of the following materials are referred to in the above Appendices A-E and are incorporated herein by reference:

[Avis et al. 1992] D. Avis and K. Fukuda. "A Pivoting Algorithm for Convex Hulls and Vertex Enumeration of Arrangements and Polyhedra." *Discrete Computational Geometry*, Volume 8 (1992), 295-313.

[Avis 2000] D. Avis. "Irs: A Revised Implementation of the Reverse Search Vertex Enumeration Algorithm." In G. Kalai and G. M. Ziegler, editors, *Polytopes—Combinatorics and Computation*, Volume 29 (2000) of *Oberwolfach Seminars*. Birkhäuser-Verlag, 177-198.

[Bernardini 1991] F. Bernardini. "Integration of Polynomials over n-Dimensional Polyhedral." *Computer-Aided Design*, Volume 23 (1991), 51-58.

[Bottomley 2004] H. Bottomley. "Partition Calculators Using Java Applets." (2004). Web. 20 Apr. 2011. <http://www.btintemet.com/~se164s/partitions.htm>.

[Bremner et al. 1997] D. Bremner, K. Fukuda, and A. Marzetta. "Primal-Dual Methods of Vertex and Facet Enumeration," *Discrete and Computational Geometry*, Volume 20 (1997), 333-358.

[Cignoni et al. 1998] P. Cignoni, C. Montani, and R. Scopigno. "DeWall: A Fast Divide and Conquer Delaunay Triangulation Algorithm in $E^d$." *Computer-Aided Design, Volume* 30 (1998), 333-341.

[Crosier 1986] R. B. Crosier. "The Geometry of Constrained Mixture Experiments." *Technometrics*, Volume 28 (1986), 95-102.

[Dyer 1983] M. E. Dyer. "The Complexity of Vertex Enumeration Methods." *Math. Operations Research*, Volume 8 (1983), 381-402.

[Fukuda et al. 1997] K. Fukuda, T. M. Liebling, and F. Margot. "Analysis of Backtrack Algorithms for Listing All Vertices and All Faces of a Convex Polyhedron." *Computational Geometry: Theory and Applications*, Volume 8 (1997), 1-12.

[Kachiyan et al. 2006] L. Khachiyan, E. Boros, K. Borys, K. M. Elbassioni, and M. Gurvich. "Generating All Vertices of a Polyhedron is Hard." *ACM SODA* (2006), 758-765.

[Matheiss et al. 1980] T. H. Matheiss and D. S. Rubin, "A Survey and Comparison of Methods for Finding all Vertices of Convex Polyhedral Sets." *Math. Operations Research.*, Volume 5 (1980), 167-185.

[McLean et al. 1966] R A. McLean and V. L. Anderson. "Extreme vertices design of mixture experiments." *Technometrics*, Volume 8 (1966), 447-454.

[Snee et al. 1974] R. D. Snee and D. W. Marquardt. "Extreme vertices designs for linear mixture models." *Technometrics*, Volume 16 (1974), 399-408.

What is claimed is:

1. A method of improving exploration of formation fluid in a formation, the method implemented using a processing unit, using memory accessible to the processing unit, and using a downhole tool disposed in a borehole of the formation having the formation fluid, the method comprising:

storing, in the memory, definitions of a plurality of possible constituents for the formation fluid;

storing, in the memory, definitions of constraints for the possible constituents;

obtaining, using the downhole tool, the formation fluid from the borehole over a plurality of time intervals;

measuring, using the downhole tool, density of the obtained formation fluid at the time intervals;

computing, using the processing unit, a state probability distribution function of each of the possible constituents of the obtained formation fluid at the time intervals based on the measured density of the obtained formation fluid and based on the defined constraints; and evaluating the formation fluid by characterizing, using the processing unit, constituents of the formation fluid based on the computed state probability distribution functions.

2. The method of claim 1, wherein storing, in the memory, the definitions of the possible constituents comprises defining a plurality of water, vapor phase gas constituents, supercritical gas constituents, liquid hydrocarbon constituents, filtrate contaminant, and solids.

3. The method of claim 1, wherein storing, in the memory, the definitions of the constraints for the possible constituents comprises defining linear constraints on a fraction of each of the possible constituents.

4. The method of claim 1, wherein storing, in the memory, the definitions of the constraints for the possible constituents comprises:

partitioning the possible constituents into possible gas constituents and possible oil constituents;

bounding each of the possible gas constituents with upper and lower fractions of the formation fluid;

bounding each of the possible oil constituents with upper and lower fractions of the formation fluid; and bounding a complete state space of the possible constituents with a collection of all the bounded fractions.

5. The method of claim 1, wherein storing, in the memory, the definitions of the constraints for the possible constituents comprises constraining a change in state of the possible constituents over time.

6. The method of claim 5, wherein constraining the change in state of the possible constituents over time comprises forcing minimum and maximum thresholds on the change encountered for at least a contamination constituent of the possible constituents from one time interval to the next time interval.

7. The method of claim 1, wherein storing, in the memory, the definitions of the constraints further comprises setting the constraints for a particular implementation.

8. The method of claim 1, wherein obtaining, using the downhole tool, the formation fluid from the borehole with the downhole tool over the time intervals comprises drawing the formation fluid from the formation into an inlet of the downhole tool.

9. The method of claim 8, wherein drawing, using the downhole tool, the formation fluid from the formation into the inlet of the downhole tool comprises isolating the inlet in communication with the formation using a probe or packers.

10. The method of claim 1, wherein measuring, using the downhole tool, the density of the obtained formation fluid at the time intervals comprises measuring the obtained formation fluid with a density sensor in communication with the formation fluid.

11. The method of claim 1, wherein computing, using the processing unit, the state probability distribution function of each of the possible formation fluid constituents at the time intervals based on the measured density of the obtained formation fluid and the constraints comprises computing a mean vector and a covariance matrix for the state of all of the possible constituents.

12. The method of claim 1, wherein obtaining, using the downhole tool, the formation fluid over the time intervals, measuring the density at the time intervals, and computing the probability distribution function for the state of all the possible constituents at the time intervals is done recursively until a threshold is reached.

13. The method of claim 12, wherein computing the probability distribution function for the state of all the possible formation fluid constituents at the time intervals based on the measured density of the obtained formation fluid and the constraints comprises:

determining a current state probability distribution of the possible constituents at a current time interval by dynamically assimilating a previous state probability distribution of the possible constituents of a previous time interval, the measured fluid density, and the constraints.

14. The method of claim 13, wherein determining the current state probability distribution of the possible constituents at the current time interval by dynamically assimilating a previous state probability distribution of the possible constituents of the previous time interval, the measured fluid density, and the constraints comprises:

obtaining state boundary constraints, state dynamic constraints, the measured density at the current time interval, and the previous state distribution;

defining a current state space for the current time interval using the state boundary constraints and the measured density;

enumerating all vertices of the current state space;

obtaining a simplicial decomposition of the current state space by triangulating the space based on the enumerated vertex set;

computing a range $[\alpha_k, \beta_k]$ of time-dependent integration over the possible constituents of the previous time interval;

computing a preliminary state probability distribution from the previous state probability distribution and the state dynamic constraints by integrating integrands over the range of $[\alpha_k, \beta_k]$; and computing the current state probability distribution by normalizing the preliminary state probability distribution with respect to the current state space and by integrating the integrands over each simplex in a simplicial decomposition of the current state space.

15. The method of claim 1, further comprising determining, using the processing unit, an expected value and a confidence interval for the gas-to-oil ratio of the formation fluid based on the characterized state probability distribution of the constituents.

16. The method of claim 1, further comprising determining, using the processing unit, a level of contamination of the formation fluid and a confidence interval based on the characterized state probability distribution of the constituents.

17. The method of claim 1, further comprising determining, using the processing unit, an interval of time in which to obtain the formation fluid to a level of contamination based on the characterized state probability distribution of the constituents.

18. A non-transitory programmable storage device having program instructions stored thereon for causing a programmable control device to perform a method of improving exploration of formation fluid in a formation, the method implemented using a processing unit, using memory accessible to the processing unit, and using a downhole tool disposed in a borehole of the formation having the formation fluid, the method comprising:

storing, in the memory, definitions of a plurality of possible constituents for the formation fluid;

storing, in the memory, definitions of constraints for the possible constituents;

obtaining, using the downhole tool, the formation fluid from the borehole over a plurality of time intervals;

measuring, using the downhole tool, density of the obtained formation fluid at the time intervals;

computing, using the processing unit, a state probability distribution function of each of the possible constituents of the obtained formation fluid at the time intervals based on the measured density of the obtained formation fluid and based on the defined constraints; and evaluating the formation fluid by characterizing, using the processing unit, constituents of the formation fluid form the borehole based on the computed state probability distribution functions.

19. A downhole formation evaluation apparatus disposing in a borehole, the apparatus comprising:

an inlet obtaining formation fluid from the borehole over a plurality of time intervals;

one or more sensors in fluid communication with the inlet and measuring at least density of the obtained formation fluid at the time intervals;

memory storing definitions of a plurality of possible formation fluid constituents and storing definitions of constraints for the possible formation fluid constituents; and a processing unit in communication with the one or more sensors and the memory, the processing unit configured to:

compute a probability of each of the possible formation fluid constituents at the time intervals based on the measured density of the obtained formation fluid, and characterize constituents of the formation fluid based on the computed probabilities to evaluate the formation fluid.

20. The apparatus of claim 19, wherein the processing unit comprises a downhole component disposed downhole, an uphole component disposed at surface, or a downhole component disposed downhole in conjunction with an uphole component disposed at surface.

21. A method of improving exploration of formation fluid in a formation, the method implemented using a processing unit, using memory accessible to the processing unit, and using a downhole tool disposed in a borehole of the formation having the formation fluid, the method comprising:

storing, in the memory, definitions of at least three or more possible formation fluid constituents;

storing, in the memory, definitions of constraints for the at least three or more possible formation fluid constituents;

obtaining, using the downhole tool, formation fluid from the borehole with the downhole tool over a plurality of time intervals;

measuring, using the downhole tool, density of the obtained formation fluid at the time intervals; and evaluating the formation fluid by characterizing, using the processing unit, a state probability distribution of the constituents of the formation fluid based on the at least three or more possible formation fluid constituents, the constraints, and the measured densities.

22. A non-transitory programmable storage device having program instructions stored thereon for causing a programmable control device to perform a method of improving exploration of formation fluid in a formation, the method implemented using a processing unit, using memory accessible to the processing unit, and using a downhole tool disposed in a borehole of the formation having the formation fluid, the method comprising:

storing, in the memory, definitions of at least three or more possible formation fluid constituents;

storing, in the memory, definitions of constraints for the at least three or more possible formation fluid constituents;

obtaining, using the downhole tool, formation fluid from the borehole with the downhole tool over a plurality of time intervals;

measuring, using the downhole tool, density of the obtained formation fluid at the time intervals; and evaluating the formation fluid by characterizing, using the processing unit, a state probability distribution of the constituents of the formation fluid based on the at least three or more possible formation fluid constituents, the constraints, and the measured densities.

* * * * *